US007951517B2

(12) United States Patent
Iwanaga et al.

(10) Patent No.: US 7,951,517 B2
(45) Date of Patent: May 31, 2011

(54) ELECTROPHOTOGRAPHIC PHOTORECEPTOR, PROCESS CARTRIDGE, AND IMAGE FORMING APPARATUS

(75) Inventors: Takeshi Iwanaga, Kanagawa (JP); Shigeru Yagi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 648 days.

(21) Appl. No.: 12/038,249

(22) Filed: Feb. 27, 2008

(65) Prior Publication Data

US 2008/0260427 A1 Oct. 23, 2008

(30) Foreign Application Priority Data

Apr. 18, 2007 (JP) ..... 2007-109132

(51) Int. Cl.
*G03G 5/147* (2006.01)

(52) U.S. Cl. ..... 430/67; 430/66; 399/159

(58) Field of Classification Search ..... 430/66, 430/67, 132; 399/159
See application file for complete search history.

(56) References Cited

U.S. PATENT DOCUMENTS

| | | | | |
|---|---|---|---|---|
| 5,242,773 | A * | 9/1993 | Iino et al. | 430/58.05 |
| 5,430,526 | A * | 7/1995 | Ohkubo et al. | 399/159 |
| 2007/0269728 | A1 * | 11/2007 | Yagi | 430/66 |

FOREIGN PATENT DOCUMENTS

| | | |
|---|---|---|
| JP | A-58-80647 | 5/1983 |
| JP | A-60-86405 | 5/1985 |
| JP | A-61-7406 | 1/1986 |
| JP | A-9-101625 | 4/1997 |
| JP | A-2003-27238 | 1/2003 |
| JP | A-2006-267507 | 10/2006 |

* cited by examiner

*Primary Examiner* — Janis L Dote
(74) *Attorney, Agent, or Firm* — Oliff & Berridge, PLC

(57) ABSTRACT

An electrophotographic photoreceptor includes an organic photosensitive layer and one or more inorganic thin film layers disposed in this order on a conductive substrate, in which among the one or more inorganic thin film layers at least an inorganic protective layer disposed directly on the organic photosensitive layer has cracks scattered at intervals from about 1 μm to about 10 mm. The inorganic thin film layer having the cracks is a first protective layer and an inorganic thin film is grown on a surface of the first protective layer to form a second protective layer.

9 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATION

This application is based on and claims priority under 35 USC 119 from Japanese Patent Application No. 2007-109132 filed Apr. 18, 2007.

BACKGROUND

1. Technical Field

The invention relates to an electrophotographic photoreceptor, a process cartridge, and an image forming apparatus.

2. Related Art

Recently, electrophotographic methods have been extensively applied to image forming apparatus, such as photocopiers or a printers. Since an electrophotographic photoreceptor (hereinafter, occasionally referred to as 'photoreceptor') used in an image forming apparatus using an electrophotographic method is exposed to various types of contacts or stresses in the device, deterioration thereof may occur. Meanwhile, high reliability is required in conjunction with digitalization or colorization of image forming apparatus.

Among such photoreceptors, currently, organic photoreceptors are extensively used. Organic photoreceptors are inexpensive in comparison with photoreceptors including amorphous silicon, and are safer than photoreceptors including selenium or cadmium sulfide. However, since organic photoreceptors have low hardness as compared to photoreceptors including selenium or cadmium sulfide, if an organic photoreceptor is repeatedly used in an image forming apparatus, abrasion may occur due to friction with a cleaning member, a developer, or the like. If the photoreceptor is abraded, problems occur such as reduced lifespan and the need for short cycle replacement. Additionally, since surface roughness is increased due to the friction, slidability may deteriorate.

In order to solve such problems, an approach of forming a hard inorganic material as a protective layer on an organic photoreceptor has been adopted. Examples of materials of such protective layers under investigation include amorphous carbon (diamond-like carbon), oxides, nitrides and nitrogen oxide, which are hard and relatively high in electric resistance. Among such inorganic materials, the present inventors have already found that thin films composed of oxygen and gallium possess both wear resistance and image maintenance properties.

In the above technique, it is desirable that the protective layer has a larger thickness in view of durability. When the protective layer has an increased thickness, the halftone concentration of output images may be greatly decreased when used repeatedly. In such a case, photoreceptors exert electric properties characterized by high residual potential, and there is the problem that a high residual potential results in fluctuations in concentration during repeated usage.

SUMMARY

According to an aspect of the invention, there is provided an electrophotographic photoreceptor comprising an organic photosensitive layer and one or more inorganic thin film layers disposed in this order on a conductive substrate, among the one or more inorganic thin film layers at least an inorganic thin film layer disposed directly on the organic photosensitive layer having cracks scattered at intervals from about 1 μm to about 10 mm.

BRIEF DESCRIPTION OF THE DRAWINGS

Exemplary embodiments of the present invention will be described in detail based on the following figures, wherein.

DETAILED DESCRIPTION

Figure 1:
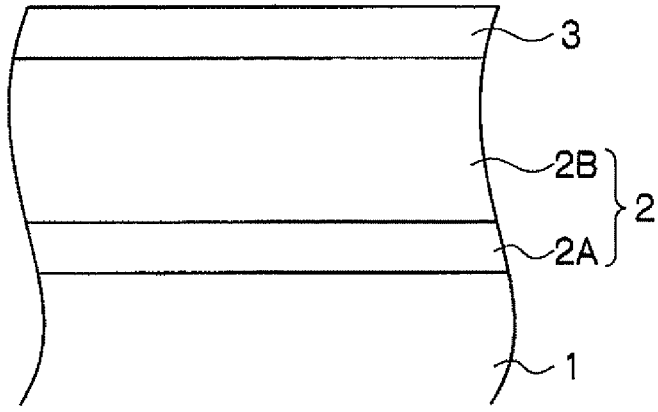
FIG. 1 is a schematic sectional view showing one example of the layer structure of the photoreceptor of the invention.

The problems mentioned above are attained by the invention shown below. That is, according to a first aspect of the invention, there is provided an item <1>; an electrophotographic photoreceptor including an organic photosensitive layer and one or more inorganic thin film layers disposed in this order on a conductive substrate, among the one or more inorganic thin film layers at least an inorganic thin film layer disposed directly on the organic photosensitive layer having cracks scattered at intervals from 1 μm or about 1 μm or more to 10 mm or about 10 mm or less.

According to a second aspect of the invention, there is provided an item <2>; the electrophotographic photoreceptor according to the item <1>, wherein the inorganic thin film layer comprises a group 13 element and nitrogen.

According to a third aspect of the invention, there is provided an item <3>; the electrophotographic photoreceptor according to the item <1> or <2>, wherein the inorganic thin film layer having cracks is a first protective layer and an inorganic thin film is crown on a surface of the first protective layer to form a second protective layer.

According to a forth aspect of the invention, there is provided an item <4>; the electrophotographic photoreceptor according to any one of items <1> to <3>, wherein the uppermost inorganic thin film layer comprises a group 13 element and oxygen.

According to a fifth aspect of the invention, there is provided an item <5>; a process cartridge configured to be attached to and detached from an image forming apparatus, the process cartridge comprising an electrophotographic photoreceptor, and at least one selected from a charging unit for charging a surface of the electrophotographic photoreceptor, a developing unit for forming a toner image by developing an electrostatic latent image formed on the surface of the electrophotographic photoreceptor with a developer including at least a toner and a transfer unit for transferring the toner image to a recording medium, the electrophotographic photoreceptor being the electrophotographic photoreceptor according to any one of items <1> to <4>.

According to a sixth aspect of the invention, there is provided an item <6>; an image forming apparatus comprising an electrophotographic photoreceptor, an exposure unit for exposing the surface of the electrophotographic photoreceptor charged by the charging unit to form an electrostatic latent image, a developing unit for developing the electrostatic latent image with a developer including at least a toner to form a toner image, and a transfer unit for transferring the toner image to a recording medium, wherein the electrophotographic photoreceptor is the electrophotographic photoreceptor according to any one of items <1> to <4>.

Exemplary embodiments of the invention are described in detail hereinafter.

<Electrophotographic Photoreceptor>

The electrophotographic photoreceptor of the invention is characterized in that it includes an organic photosensitive layer and one or more inorganic thin film layers disposed in this order on a conductive substrate and that at least an inorganic thin film layer disposed directly on the organic photosensitive layer among the one or more inorganic thin film layers has cracks scattered at intervals from 1 μm or about 1 μm or more to 10 mm or about 10 mm or less.

As mentioned above, the forming of an inorganic thin film as a protective layer on an organic photoreceptor is accompanied by a problem that the residual potential of a photoreceptor increases. Such a residual potential problem becomes more remarkable with increase in thickness of the inorganic thin film, and in some cases a residual potential of 100 V or more is generated. On the other hand, it has been found that when a photoreceptor like that mentioned above has a protective layer with the cracks, it shows an image concentration close to that of a non-coated (i.e., inorganic thin film layer-free) organic photoreceptor locally around the cracks. In such a case, there is a problem that the halftone image concentration becomes high along the cracks, resulting in occurrence of in-plane nonuniformity of halftone image output property.

Further investigation about the above-mentioned results made by the present inventors revealed that in comparison to areas with no cracks, almost no increase in residual potential is detected in the areas around the cracks. It was also found that by adjusting the intervals between cracks below a certain value by increasing the number of cracks, it is possible to control the increase in residual potential throughout the surface of the photoreceptor without reducing the quality of image.

Specifically, by adjusting the intervals between cracks into the range from 1 μm or about 1 μm or more to 10 mm or about 10 mm or less, it is possible to improve the electric property of the entire surface of the photoreceptor (specifically, reduce the residual potential) and thereby obtain an output image concentration uniform in the plane.

If the intervals of the cracks is greater than about 10 mm, the residual potential will become high and image concentration will be low in some portions of an output image. If the intervals are less than about 1 μm, the inorganic thin film will fall almost into a state where it has minute cracks and, as a result, the durability of the film will decrease.

Although the mechanism of the suppression of the increase in residual potential around the cracks is not clear, the correlation between the increase in residual potential and the decrease in image concentration is clear. From the fact that the image concentration becomes high at and around cracks as mentioned above, it is conceivable that the increase in residual potential occurs when something controlling electric conduction, like a piozoelectric field, caused by an internal stress between the organic photoreceptor and the inorganic protective layer is released around the cracks.

In this exemplary embodiment, a crack is a linear cleft having a maximum width of about 1 μm or less or a point-like depression having a maximum diameter of about 1 μm or less. The linear crack may be in either a straight line form or a loop form. Linear cracks may be present separately away from each other or may be in a closed form defined by a plurality of linear cracks. Although the depth of a crack (i.e., the distance from the surface of the inorganic thin film having the crack) is not particularly limited, it is desirable that the crack has a depth similar to the thickness of the film, namely, the crack reaches the lower layer of the inorganic thin film having the crack so that the film is separated into some portions.

In this exemplary embodiment, the "interval between cracks" is a shortest distance from an arbitrary point on one crack to another crack.

When a crack is linked to other cracks to form a closed form, the interval is a distance from one crack to another crack in the closed form.

Such cracks may be detected by visual inspection or light or electron microscopic inspection. In the observation by a microscope, the focus is adjusted on the inorganic thin film having the cracks grown on the organic photoreceptor. The method for measuring the intervals between cracks may be determined by visual or microscopic inspection. As the method for automatically measuring the entire surface of a drum-shaped photoreceptors for example, a method in which the surface of the photoconductor is exposed to light and the light reflected by the surface is detected with a CCD camera, followed by image processing (see JP-A No. 61-7406), or a method in which laser light is scanned with a polygon mirror along the axial direction of the photoreceptor drum and the light scattered from defects is detected (see JP-A No. 60-86405) may be used.

On the other hand, the maximum width and the maximum diameter of the cracks may be checked with a scanning electron microscope (SEM). The depth of a crack may be checked through height profile measurement using an atomic force microscope (AFM) or a laser microscope, or cross-section SEM observation.

Hereafter, the configuration of the electrophotographic photoreceptor of the invention is described first with reference to some exemplary embodiments. FIG. 1 is a schematic sectional view showing one example of the layer structure of the photoreceptor of this exemplary embodiment. In FIG. 1, reference numeral 1 represents a conductive substrate, 2 indicates a photosensitive layer, 2A represents a charge generation layer, 2B expresses a charge transport layer, and 3 represents a protective layer (inorganic thin film layer). The photoreceptor shown in FIG. 1 has a layer structure in which a charge generation layer 2A, a charge transport layer 2B, and a protective layer 3 are disposed in this order on a conductive substrate 1, and the photosensitive layer 2 is made up of two layers, namely, the charge generation layer 2A and the charge transport layer 2B.

Figure 2:
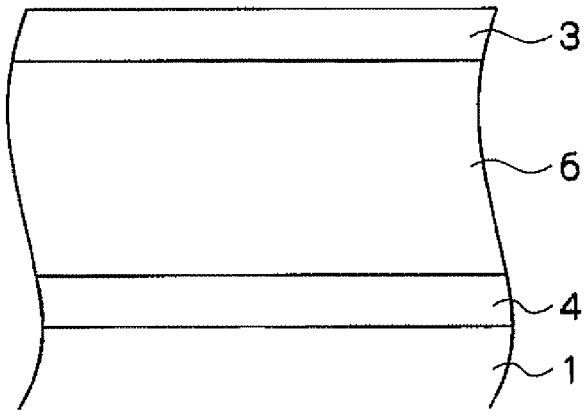
FIG. 2 is a schematic sectional view showing another example of the layer structure of the photoreceptor of the invention.

FIG. 2 is a schematic sectional view showing another example of the layer structure of the photoreceptor of this exemplary embodiment. In FIG. 2, reference numeral 6 indicates a photosensitive layer, 4 represents an under coating layer, and other numerals are the same as those shown in FIG. 1. The photoreceptor shown in FIG. 2 has a layer structure in which a under coating layer 4, a photosensitive layer 6 and a protective layer 3 are disposed in this order on a conductive substrate 1. The photosensitive layer 6 is a layer having functions of the charge generation layer 2A and the charge transport layer 2B shown in FIG. 1.

The photosensitive layers 2 and 6 in this exemplary embodiment are made of an organic material and, therefore, are organic photosensitive layers.

The protective layer 3 in this exemplary embodiment is an inorganic thin film layer, and a material which has hard and has an appropriate electric resistance is used. The electric resistance range, which depends on the film thickness, is preferably, in volume resistivity, $10^6\Omega\cdot$cm or more, and more preferably $10^8\Omega\cdot$cm or more. If the volume resistivity is less than such ranges, charges will flow in the in-plane direction and it may be impossible to form electrostatic latent images.

The inorganic thin film layer preferably comprises a group 13 element and nitrogen. Inclusion of a group 13 element and nitrogen makes the inorganic thin film layer a film excelling in durability as a protective layer and makes it possible to produce the form and distribution state of cracks in this exemplary embodiment in the method of crack formation mentioned later.

As the material of such an inorganic thin film layer, oxides such as gallium oxide, aluminum oxide, indium oxide and zinc oxide, gallium nitride, aluminum nitride, indium nitride, boron nitride, diamond-like graphite, silicon carbide, and the like may be used.

Of the elements, the protective layer 3 that is formed of an inorganic thin film containing any one or both of Ga and Al which are the group 13 element is advantageous in that it is possible to control electric conductive property by addition of impurities, chemical stability is high, wear resistance is excellent due to high hardness, the surface of the layer oxidized through natural oxidation has the high water repellency, the water repellency is not reduced, and lubrication is excellent when the layer is used as the electrophotographic photoreceptor.

Even after the protective layer 3 that contains the group 13 element and nitrogen is left in the air, or even after the protective layer 3 is used as the electrophotographic photoreceptor, the water repellency is excellent. Furthermore, when the layer is used as the electrophotographic photoreceptor, the lubrication is poor at an early step as compared to the organic photoreceptor on which the protective layer 3 is not formed, but the lubrication is significantly improved after the use of layer is repeated.

As the group 13 element contained in the protective layer 3, at least one or more elements selected from B, Al, Ga and In may be used. Two or more elements may also be included. In this case, because elements other than In absorb no visible light, the combination of the contents of these atoms in the protective layer is not particularly restricted. However, because In absorbs visible light, it is necessary to pay attention to the exposure wavelength and the erasion wavelength, etc. of an electrophotographic system to be used, and also to select the contents so that such lights are absorbed as less as possible.

Moreover, various types of dopants may be added to the protective layer in order to control its conduction type.

When controlling the conduction type to n-type, one or more elements selected from Si, Ge and Sn, for example, may be used.

When controlling the conduction type to p-type, one or more elements selected from Be, Mg, Ca, Zn and Sr, for example, may be used.

In any event where the protective layer 3 is microcrystalline, polycrystalline or amorphous, the internal structure thereof tends to include many defects such as bond defects, rearrangement defects and defects in grain boundaries. Therefore, in order to deactivate such defects, hydrogen and/or halogen elements may be contained in the protective layer. Hydrogen and halogen elements in the protective layer are captured into bond defects or defects in grain boundaries in crystals to eliminate reactive sites, thereby performing electric compensation. Therefore, because trapping involving diffusion or movement of carriers in the protective layer is controlled, it is possible to stabilize the increase in residual potential and the charging property of the photoreceptor surface due to internal charge accumulation occurring during repetition of charging and exposure.

The thickness of the protective layer 3 is preferably within the range of from 0.01 μm to 3.0 μm, and more preferably within the range of 0.05 μm to 1.0 μm.

If the protective layer 3 has a thickness of 0.01 μm or less, improvement in wear resistance may not be obtained, and if the thickness is 3.0 μm or more, electric properties, such as sensitivity, residual potential and repetition, may be poor. Moreover, also in various methods for forming cracks mentioned later, it is desirable to adjust the thickness of the layer to the ranges shown above because it is possible to form cracks with a desired shape at desired intervals.

Each layer of the photoreceptor of an exemplary embodiment of the present invention will be described in more detail along with the method for manufacturing the same.

The layer structure of the photoreceptor of an exemplary embodiment of the present invention includes a photosensitive layer (organic photosensitive layer) and a protective layer (inorganic thin film) laminated on a conductive substrate in this order. The photosensitive layer of an exemplary embodiment of the present invention is an organic photosensitive layer including an organic substance. An under-coating layer such as an intermediate layer may be provided between these layers, if necessary. The photosensitive layer may include plural layers as described above, and each layer may have a different function (function separation type).

The organic polymer compound forming the photosensitive layer may be thermoplastic or thermosetting, or it may be formed by reacting two types of molecules. Moreover, between the photosensitive layer and the protective layer may be provided an intermediate layer from the viewpoints of adjusting the hardness, the coefficient of expansion, and the elasticity, improving the adhesiveness, and the like. The intermediate layer may show intermediate characteristics with respect to both of the physical characteristics of the protective layer and the physical characteristics of the photosensitive layer (charge transport layer in the case of the function separation type). Moreover, if the intermediate layer is provided, the intermediate layer may act as a layer which traps charges.

The organic photosensitive layer may be a function separation type photosensitive layer 2 having the charge generation layer 2A and the charge transport layer 2B separately as shown in FIG. 1, or may be a function integration type photosensitive layer 6 as shown in FIG. 2. In the case of the function separation type, the surface side of the photoreceptor may be provided with the charge generation layer, or the surface side may be provided with the charge transport layer. A photosensitive layer will be described below focusing on the function separation type photosensitive layer 2.

If a protective layer 3 is formed on the photosensitive layer by a method described later, in order to prevent decomposition of the photosensitive layer 2 due to the irradiation of electromagnetic radiation of shorter wavelengths other than heat, the photosensitive layer surface may be previously provided with a short-wavelength light absorber layer against ultraviolet light or the like, prior to formation of the protective layer 3. Moreover, so as not to irradiate short-wavelength light onto the photosensitive layer 2, a layer having a small band gap may be firstly formed at the initial stage for forming the protective layer 3. The composition of such a layer having a small band gap provided on the photosensitive layer side, for example, may be GaXIn(1−X) ($0 \leqq X \leqq 0.99$) including In.

Moreover, the layer containing an ultraviolet absorber (for example, a layer formed by application or the like of a layer dispersed in a polymeric resin) may be provided on the photosensitive layer surface.

In this manner, prior to formation of the protective layer 3, the photoreceptor surface is provided with the intermediate layer, and thereby effects on the photosensitive layer by short-wavelength light such as ultraviolet light when forming the protective layer 3, corona discharge if the photoreceptor is used in the image forming apparatus, or ultraviolet light from other various light sources may be prevented.

While the protective layer 3 may be either amorphous or crystalline, it is preferable that the upper layer (the surface side of the photoreceptor) of the protective layer 3 is also amorphous for improving slidability of the surface of the photoreceptor.

The protective layer 3 may be injected with charges during electrification. In this case, the electric charge should be trapped at the interface between the protective layer 3 and photosensitive layer 2. Alternatively, the charge may be trapped on the surface of the protective layer 3. For example, when the photosensitive layer 2 is a layer of a function separation type as shown in FIG. 1, the surface at the protective layer side of the charge transporting layer may serve for trapping the charge when electrons are injected from the negatively charged protective layer 3, or an intermediate layer may be provided between the charge transporting layer and protective layer 3 for blocking injection of the charge and trapping. The process may be the same when the surface layer is positively charged.

Moreover, the protective layer 3 may have a function as the charge injection blocking layer, or may also have a function as the charge injection layer. In this case, as described above, by adjusting the conduction type of the protective layer 3 to n-type or p-type, the protective layer 3 may act as the charge injection blocking layer, or as the charge injection layer too.

If the protective layer 3 acts as the charge injection layer, charges are trapped on the surface of the intermediate layer or the photosensitive layer 2 (surface on the protective layer side). In the case of negative electrification, an n-type protective layer acts as the charge injection layer and a p-type protective layer acts as the charge injection blocking layer. In the case of positive electrification, an n-type protective layer acts as the charge injection blocking layer and a p-type protective layer acts as the charge injection layer.

(Formation of Protective Layer, Formation of Cracks)

The method for forming the protective layer 3 will be described below. The protective layer 3 may be formed directly on the photosensitive layer so that the group 13 element and nitrogen are contained. The surface of the photosensitive layer 2 may be cleaned with plasma.

For the formation of the protective layer 3, there may be used a publicly known vapor phase film-formation method, such as plasma CVD (Chemical Vapor Deposition) method, sputtering method, the electron-beam vapor deposition method, the molecular-beam epitaxy method or the like. Hereinafter, the formation of the protective layer 3 will be described with reference to the drawings of the apparatus used for forming the surface layer 3.

Figure 4:
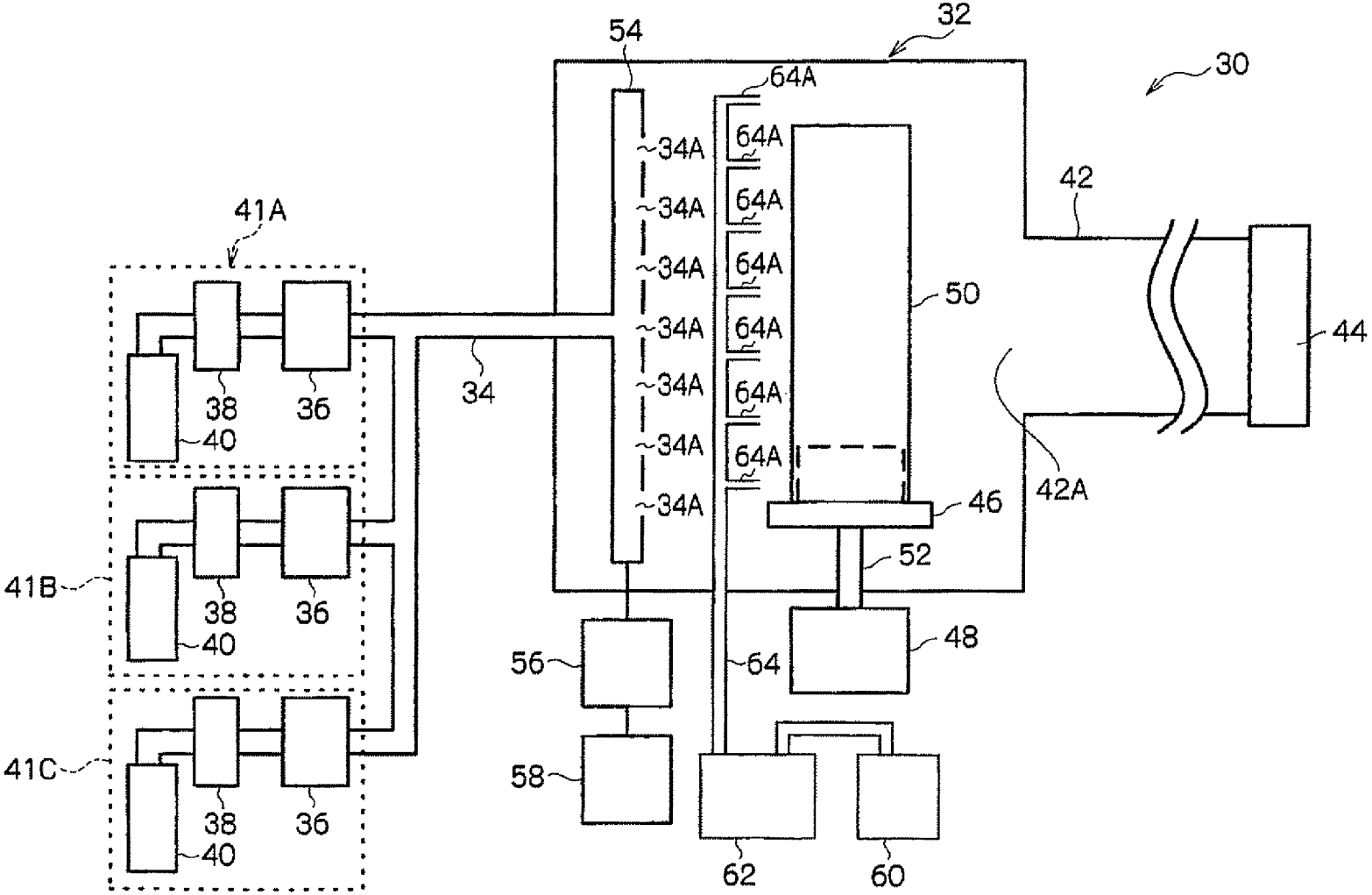
FIG. 4 is a diagram schematically illustrating one example of the film forming apparatus to be used for the invention.

FIG. 4 schematically illustrates the film forming apparatus that is used for forming the protective layer for the photoreceptor according to an exemplary embodiment of the present invention.

A film forming apparatus 30 includes a vacuum chamber 32 for vacuum exhaustion.

In the vacuum chamber 32, a support member 46 is provided to rotatably support an electrophotographic photoreceptor 50 which is not subjected to forming the protective layer (hereinafter, referred to as 'non-coated photoreceptor') so that a longitudinal axis of the non-coated photoreceptor 50 is identical to a rotation axis. The support member 46 is connected through a support shaft 52 for supporting the support member 46 to a motor 48, and a driving force of the motor 48 is capable of being transferred through the support shaft 52 to the support member 46.

After the non-coated photoreceptor 50 is supported by the support member 46, the motor 48 is driven to transfer the driving force of the motor 48 through the support shaft 52 and the support member 46 to the non-coated photoreceptor 50, thus rotating the non-coated photoreceptor 50 while the longitudinal axis is identical to the rotation axis.

An exhaust pipe 42 is formed at an end of the vacuum chamber 32 to exhaust gas from the vacuum chamber 32. The exhaust pipe 42 communicates with the vacuum chamber 32 through an opening 42A of the vacuum chamber 32 at an end thereof, and is connected to a vacuum exhaust unit 44 at another end thereof. The vacuum exhaust unit 44 includes one or a plurality of vacuum pumps. However, the vacuum exhaust unit may include a unit for controlling an exhaust rate, such as a conductance valve, if necessary.

If air is exhausted from the vacuum chamber 32 through the exhaust pipe 42 using the driving of the vacuum exhaust unit 44, an internal pressure of the vacuum chamber 32 is reduced to a predetermined pressure. The predetermined pressure may be the pressure capable of generating plasma in the vacuum chamber 32 as described later, and depends on the type of gas, supplied power, and the frequency of an electric source. In detail, it is preferable that the pressure be 1 to 200 Pa.

A discharge electrode 54 is formed in the vicinity of the non-coated photoreceptor 50 which is provided in the vacuum chamber 32. The discharge electrode 54 is electrically connected through a matching box 56 to a high frequency electric source 58. A direct current electric source or an alternating current electric source may be used as the high frequency electric source 58, and it is preferable to use the high frequency electric source of the alternating current because gas is efficiently excited.

The discharge electrode 54 has a plate shape, and is provided so that a longitudinal-axis direction of the discharge electrode 54 is identical to a rotation-axis direction (longitudinal-axis direction) of the non-coated photoreceptor 50. The discharge electrode 54 is spaced from an external circumferential surface of the non-coated photoreceptor 50. The discharge electrode 54 has a hollow structure (cave shape), and one or a plurality of openings 34A in a discharge side thereof to feed gas for generating plasma. If the discharge electrode 54 does not have the cave shape and the openings 34A on the discharge side thereof the gas for generating the plasma is fed through a gas inlet that is separately formed, and flows between the non-coated photoreceptor 50 and the discharge electrode 54. Additionally, in order to prevent the occurrence of discharge between the discharge electrode 54 and the vacuum chamber 32, it is preferable that an earthed member cover an electrode side other than a side facing the non-coated photoreceptor 50 while a clearance of about 3 mm or less is left.

If high frequency power is supplied from the high frequency electric source 58 through the matching box 56 to the discharge electrode 54, the discharge is caused by the discharge electrode 54.

A gas feeding pipe 34 is formed in a region that faces the non-coated photoreceptor 50 so that the discharge electrode 54 is provided between the region and the untreated photoreceptor in the vacuum chamber 32, thus feeding gas through the hollow discharge electrode 54 to the non-coated photoreceptor 50 in the vacuum chamber 32.

The gas feeding pipe 34 communicates with the discharge electrode 54 at an end thereof (that is, the gas feeding pipe communicates with the vacuum chamber 32 through the discharge electrode 54 and the openings 34A), and is connected to a gas feeder 41A, a gas feeder 41B, and a gas feeder 41C at another end thereof.

The gas feeder 41A, the gas feeder 41B, and the gas feeder 41C each include an MFC (mass flow controller) 36 for controlling a feed rate of the gas, a pressure controller 38, and a gas feeding source 40. The gas feeding sources 40 of the gas feeder 41A, the gas feeder 41B, and the gas feeder 41C are connected through the pressure controllers 38 and the MFCs 36 to another end of the gas feeding pipe 34.

While a feeding pressure of the gas is controlled by the pressure controller 38 and the feeding rate of the gas is controlled by the MFC 36, the gas is fed from the gas feeding source 40 through the gas feeding pipe 34, the discharge electrode 54, and the openings 34A to the non-coated photoreceptor 50 of the vacuum chamber 32.

Additionally, the types of gases that are charged in the gas feeding sources 40 provided in the gas feeder 41A, the gas feeder 41B, and the gas feeder 41C may be the same. However, in the case of when treatment is performed using a plurality of types of gases, the gas feeding sources 40 where different types of gases are charged may be used. In this case, different types of gases are fed from the gas feeding sources 40 of the eras feeder 41A, the gas feeder 41B, and the gas feeder 41C to the gas feeding pipe 34 to form a mixture gas, and the mixture gas is fed through the discharge electrode 54 and the openings 34A to the non-coated photoreceptor 50 in the vacuum chamber 32.

Further, raw material gas containing a group 13 element is also supplied to the non-coated photoreceptor 50 in the vacuum chamber 32. The raw material gas is introduced from a raw material gas feeding source 62 into the vacuum chamber 32 via a gas introduction pipe 64 whose tip is a shower nozzle 64A.

In the example shown in FIG. 4 described is a case where the discharge system by the discharge electrode 54 is capacitance type. The discharge system, however, may alternatively be inductance type.

The film formation may be performed, for example, as follows. First, while keeping the pressure in a vacuum chamber 32 reduced at a predetermined pressure by a vacuum exhaust unit 44, a high frequency power is supplied from a high frequency electric source 58 to a discharge electrode 54 via a matching box 56, and $H_2$ gas or mixed gas containing $N_2$ and $H_2$ is introduced into the vacuum chamber 32 through a gas supply line 34 simultaneously with the supply of the high frequency power.

In connection with this, the plasma of the gas containing hydrogen or hydrogen and nitrogen is formed so as to radially spread from the discharge side of the discharge electrode 54 to the opening 42A of the exhaust pipe 42.

Furthermore, it is preferable that the pressure in the vacuum chamber 32 be 1 to 2000 Pa during the formation of the plasma.

Next, by introducing gaseous trimethylgallium (organometallic compound containing a group 13 element) having been diluted with hydrogen using hydrogen as a carrier gas, into the vacuum chamber 32 via a gas introduction pipe 64 and a shower nozzle 64A while causing hydrogen from a gas feeding source 60 to pass through a raw material gas feeding source 62, it is possible to cause activated nitrogen and trimethylgallium to react in an atmosphere containing active hydrogen, and thereby forming a film containing hydrogen, nitro-en and gallium in the surface of the non-coated photoreceptor 50.

In this exemplary embodiment, it is desirable to form a film with a compound of a group 13 element and nitrogen containing hydrogen on the non-coated photoreceptor 50 by introducing $N_2$ gas and $H_2$ gas as a mixture into the discharge electrode 54 and simultaneously producing active species, thereby decomposing trimethylgallium gas.

By activating hydrogen gas and nitrogen gas simultaneously within a plasma and causing an organometallic compound containing a group 13 element to react, it is possible to obtain an etching effect of a film growing on the surface of the photoreceptor due to the active hydrogen generated by plasma discharge, thereby forming a film of a compound containing a group 13 element and nitrogen having, even at low temperatures, film qualities equivalent to those at the time of high-temperature growing without damaging an organic material in the surface of the organic material (organic photosensitive layer).

Specifically, the hydrogen gas concentration in the mixed gas composed of nitrogen gas and hydrogen gas which is to be supplied for activation is desirably within a range of from 10 volume % to 95 volume %. If the hydrogen gas concentration is less than 10 volume %, even at low temperatures, an etching reaction is performed insufficiently to produce a nitride compound of a group 13 element having a large hydrogen content to lead to insufficient water resistance, which may result in formation of a film unstable in the air. If the hydrogen gas concentration is higher than 95 volume %, because an etching reaction occurs too much at the time of film growth, the film growing rate becomes low and, with regard to film quality, the growing surface becomes coarse, resulting in a poor film having an excessively high hydrogen content. The hydrogen gas concentration is more preferably adjusted within a range of from 10 volume % to 90 volume %.

The surface temperature of the non-coated photoreceptor 50 is not limited during the film forming. However, it is preferable to perform the treatment at 0° C. or higher to 150° C. or lower. Furthermore, in the case of film-formation, it is preferable that the surface temperature of the non-coated photoreceptor 50 be 100° C. or less. In the case of when the surface temperature is higher than 150° C. due to the plasma even though the temperature of the untreated photoreceptor 50 is 150° C. or less, the organic photoreception layer may be damaged by heat. Thus, it is preferable to set the temperature of the non-coated photoreceptor 50 in consideration of the above-mentioned fact.

Additionally, the surface temperature of the non-coated photoreceptor 50 may be controlled using a method not shown, or a natural increase in temperature during the discharging may be used. In the case of when the non-coated photoreceptor 50 is heated, a heater may be provided out of the non-coated photoreceptor 50 or in the non-coated photoreceptor. In the case of when the non-coated photoreceptor 50 is cooled, cooling gas or liquid may circulate in the non-coated photoreceptor 50.

In order to avoid an increase in temperature of the non-coated photoreceptor 50 due to the discharge, it is preferable to control the flow of gas that comes into contact with the surface of the non-coated photoreceptor 50 and has high energy. In connection with this, conditions, such as the flow rate of gas, a discharge output, and a pressure, may be adjusted to obtain the desired temperature.

In the method of generating the plasma using the film forming apparatus 30 shown in FIG. 4, a high frequency oscillation device is used, but the device is not limited thereto. For example, a microwave oscillation device may be used, or an electro-cyclotron resonance type or helicon plasma type of device may be used. Furthermore, the high frequency oscillation device may be an inductance type or a capacitance type.

In an exemplary embodiment of the present invention, the plasma generating device includes the discharge electrode 54, the high frequency electric source 58, the matching box 56, the gas feeding pipe 34, the MFC 36, the pressure controller 38, and the gas feeding source 40, and one plasma generating device is used. However, two or more types of plasma generating devices may be used in combination, or two or more devices that are the same type may be used. Additionally, a capacitance combination type of plasma CVD apparatus where a cylindrical electrode surrounds the cylindrical non-coated photoreceptor 50 may be used, or a device where the discharge occurs between the parallel plate electrode and the non-coated photoreceptor 50 may be used.

In the case of when two or more plasma generating devices that are different types are used, it is necessary to simultaneously form discharges using the same pressure. Furthermore, a difference in pressure may be formed in a discharge region and a film-forming region (on which the non-coated photoreceptor 50 is provided). The devices may be disposed in series with respect to the gas flow ranging from a gas inlet to a gas outlet in the treatment device, or the devices may be disposed so as to face the film-forming surface of the non-coated photoreceptor 50.

As to the as containing the group 13 element, instead of trimethylgallium gas, trietylgallium can be used. An organometallic compound containing indium or aluminum instead of gallium may be used. A hydride such as diborane may be used. Two or more types thereof may be mixed and used.

For example, at the beginning of the film formation of the protective layer 3, if a film containing nitrogen and indium is formed on the non-coated photoreceptor 50 by introducing trimethylindium into the vacuum chamber 32 through the gas introduction pipe 64 and the shower nozzle 64A, this film can absorb ultraviolet rays which are generated if the film is continuously formed, and which deteriorate the photosensitive layer 2. As a result, damage to the photosensitive layer 2 due to the generation of ultraviolet rays at the time of film formation can be suppressed.

When forming a film with excellent property according to an exemplary embodiment of the invention, a ratio of the mixed gas of nitrogen and hydrogen gases to the gas containing the group 13 element and a career gas (the mixed gas the gas containing the group 13 element (volume ratio)) in the vacuum chamber 32 is preferable in the range from 1:50 to 1:1000.

Moreover, the protective layer 3 may be added with a dopant in order to control its conduction type. As to the method of doping at the time of film formation, there may be used SiH3 and SnH4 for n-type, and biscyclopentadienylmagnesium, dimethylcalcium, dimethylstrontium, dimethylzinc, and diethylzinc for p-type in gas state. Moreover, in order to dope a dopant element in the protective layer, there may be employed a publicly known method such as a thermal diffusion method and an ion implantation method.

Specifically, by introducing a gas containing at least one dopant element into the vacuum chamber 32 through the gas introduction pipe 64 and the shower nozzle 64A, a protective layer 3 of any conduction type such as n-type and p-type can be obtained.

By means of the abovementioned method, the activated hydrogen and nitrogen, and the group 13 element are present on the photoreceptor, and furthermore the activated hydrogen has an effect of releasing hydrogen of a hydrocarbon group such as a methyl group and an ethyl group included in the organometallic compound, as a molecule. As a result, on the surface of the photoreceptor is formed a protective layer 3 of a hard film, where hydrogen, nitrogen and the group 13 element constitute a three dimensional bonding.

Differing from carbon atoms of sp2 bond type other than sp3 contained in a silicone carbide, such a hard film becomes transparent since Ga and N forms sp3 bonds such as carbon atoms constituting a diamond. Furthermore, this hard film can be made into a film containing oxygen by introducing oxygen by natural oxidization or an oxidization treatment using such as oxygen or ozone after film formation. This film is transparent and hard, and the surface of the film is water repellant with low friction.

Cracks to be formed in the protective layer 3 may be formed by application of stress such as out-of-plane deformation, in-plane compression and in-plane tension. Although cracks in this exemplary embodiment may be formed by any technique shown above, cracks formed by compression are preferred because the base material is hardly exposed through clefts.

Although cracks in the protective layer in this exemplary embodiment may be introduced either during the protective layer formation or after formation of the thin film, it is desirable to intentionally introduce a separate step of introducing cracks. The step of introducing the cracks may, for example, be a method which includes generating an internal stress due to the difference in coefficient of thermal expansion between a protective layer and an organic photoreceptor by holding them under a temperature condition different from that in the film formation, thereby forming cracks. Specifically, it is desirable that the film formation is conducted within a temperature range of from 20° C. to 100° C. and then the product is left at rest in an environment conditioned within the range of from 0° C. to 20° C.

Cracks in this exemplary embodiment are required to scatter at intervals within a range of from 1 μm or more to 10 mm or less. In the case of the protective layer formed in the manner described above, there is a tendency that the larger the difference between the temperature at the time of film formation and the temperature at the time of leaving at rest, the narrower the crack intervals. In order to generate cracks at desired intervals by this method, it is desirable to adjust the difference between the temperature at the time of film formation and the temperature at the time of leaving at rest within a range of from 10° C. to 80° C., and more desirably within a range of from 20° C. to 60° C.

The time of leaving at rest is desirably adjusted within a range of from 0.5 hours to 1000 hours.

At this time, the density of cracks may be changed by varying the thickness of the protective layer or the organic photosensitive layer. Specifically, when the thickness of the organic photosensitive layer is adjusted within a range of from 10 μm to 60 μm, it is desirable to adjust the thickness ratio of the protective layer and the organic photosensitive layer (protective layer/photosensitive layer) within a range of from 0.001 to 0.1, and more preferably within a range of from 0.002 to 0.02.

One example of the method corresponding to the aforementioned in-plane tension is one in which a uniform protective layer is formed by eliminating the difference between the temperature at the time of film formation and the temperature at the time of subsequent leaving at rest almost completely and then cracks are formed by increasing the temperature of the entire photoreceptor to stretch the hard protective layer (inorganic thin film). Also in this case, there is a tendency that the higher the temperature to which the film is heated after film formation, the narrower the cracks become. In order to form cracks at desired intervals, it is desirable to adjust the temperature after elevation within a range of from 10° C. to 80° C., and more preferably within a range of from 20° C. to 60° C. when film formation and leaving at rest were conducted at room temperature (25° C.).

Furthermore, by rotating a drum while keeping a blade-like material such as rubber in contact under a load, it is possible to introduce cracks only in a protective layer without damaging an organic photosensitive layer. Specifically, in order to form cracks at intervals within a range of from 1 μm or about 1 μm or more to 10 mm or about 10 mm or less) throughout a photoreceptor, desired cracks may be formed by rotating the drum using a blade made of urethane under a load adjusted within a range of from 0.1 g/m to 10 g/m.

Figure 3:
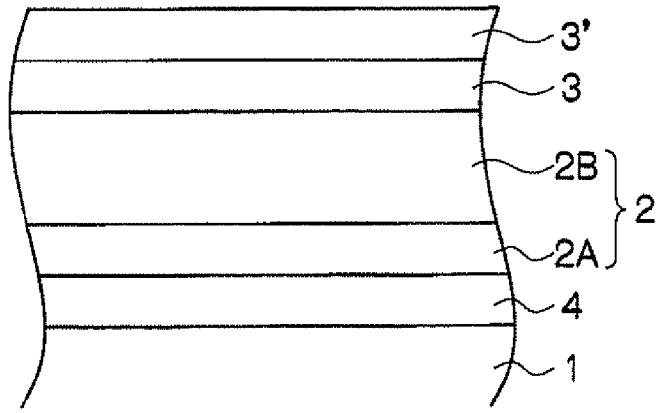
FIG. 3 is a schematic sectional view showing another example of the layer structure of the photoreceptor of the invention.

In this exemplary embodiment, at least the inorganic thin film layer formed directly on the organic photosensitive layer has the aforementioned specific cracks. Further, as shown in FIG. 3, if the inorganic thin film layer formed on the organic photosensitive layer has such cracks, it is possible to obtain a similar effect even when further forming an inorganic thin film layer (second protective layer 3') on the inorganic thin film layer (first protective layer 3) having the cracks. In this case, although the inorganic thin film layer which is the second protective layer 3' may also have cracks similar to those in the first protective layer, the layer desirably has no cracks from the viewpoint of improvement in durability of the photoreceptor. Also in such a case, cracks may be detected by the observation method previously described because light is scattered due to the cracks.

As described above, it is desirable to cause the inorganic thin film layer to include oxygen. In particular, it is desirable to form the uppermost layer of a photoreceptor with the inorganic thin film layer because an inorganic thin film layer including a group 13 element and oxygen has a considerably high water repellence. In particular, materials containing gallium and oxygen, such as gallium oxide, gallium oxynitride and those containing hydrogen are preferable as an uppermost surface layer because such materials are hard and highly water repellent and may maintain high water repellency when being used repeatedly as an electrophotographic photoreceptor. Further, it is desirable that the inorganic thin film layer as the second protective layer 3' be the uppermost surface layer.

As described above, the most desirable configuration in this exemplary embodiment may be one in which a GaN film with cracks is on an organic photosensitive layer and a GaON film may be further on the GaN film.

With regard to the thickness of each film, it is desirable that the GaN film has a thickness within the range of from 0.05 μm to 2.0 μm, and the GaON film has a thickness within the range of from 0.01 μm to 10 μm.

(Conductive Substrate and Photosensitive Layer)

Next is a description of details of the conductive substrate and the photosensitive layer of the electrophotographic photoreceptor of an exemplary embodiment of the invention, and details of the under coating layer and the intermediate layer provided as required, in the case where the electrophotographic photoreceptor of an exemplary embodiment of the invention is an organic photoreceptor including a function separation type organic photosensitive layer (configuration of FIG. 1 and FIG. 3).

Examples of the conductive substrate 1 include: a metal drum of for example aluminum, copper, iron, stainless, zinc, and nickel; a metal such as aluminum, copper, gold, silver, platinum, palladium, titanium, nickel-chromium, stainless steel, and copper-indium deposited on a base material such as a sheet, a paper, a plastic, and a glass; a conductive metal compound such as indium oxide and tin oxide deposited on the base material; a metal foil laminated on the base material; and carbon black, indium oxide, tin oxide-antimony oxide powder, metal powder, copper iodide, and the like dispersed into a binder resin and applied on the base material for conduction treatment. Moreover, the shape of the conductive substrate may be any one of drum shape, sheet shape, and plate shape.

Moreover, if a metal pipe substrate is used as the conductive substrate, the surface of the metal pipe substrate may be the original pipe as it is. However, it is also possible to roughen the surface of the substrate surface by a surface treatment in advance. Such a surface roughening can prevent the uneven concentration in the grain form due to the coherent light which may occur in the photoreceptor if a coherent light source such as a laser beam is used as an exposure light source. The method of surface treatment includes specular cutting, etching, anodization, rough cutting, centerless grinding, sandblast, and wet honing.

In particular, from the point of improving the adhesiveness with the photosensitive layer 2 and improving the film forming property, one having an anodized surface of the aluminum substrate may be used as the conductive substrate.

Hereunder is a description of a method of manufacturing the conductive substrate 1 having the anodized surface. First, as to the substrate, pure aluminum or aluminum alloy (for example, aluminum or aluminum alloy of number between 1000 and 1999, between 3000 and 3999, or between 6000 and 6999 defined in JIS, the disclosure of which is incorporated by reference) is prepared. Next, anodization is performed. The anodization is performed in an acid bath of for example chromic acid, sulfuric acid, oxalic acid, phosphoric acid, boric acid, and sulfamic acid. Treatment using a sulfuric acid bath is often used. The anodization is performed for example under a condition of about sulfuric acid concentration: from 10 weight % to 0 weight %: bath temperature: from 5° C. to 25° C., current density; from 1A/dm2 to 4A/dm2, bath voltage: from 5V to 30V, and treatment time: 5 minutes to 60 minutes, however it is not limited to this.

The anodized film formed on the aluminum substrate in this manner is porous and highly insulative, and has a very unstable surface. Therefore, after forming the film, the physical characteristics value is easily chanced over time. In order to prevent this change of the physical characteristics value, the anodized film is further sealed. Example of the sealing methods include a method of soaking the anodized film in an aqueous solution containing nickel fluoride or nickel acetate, a method of soaking the anodized film in boiling water, and a method of treating by steam under pressure. Among these methods, the method of soaking in an aqueous solution containing nickel acetate is most often used.

On the surface of the anodized film that has been sealed in this manner, metal salts and the like adhered by the sealing remain in excess. If such metal salts and the like remain in excess on the anodized film of the substrate, not only the quality of the coating film formed on the anodized film is badly affected, but also low resistant components tend to remain in general. Therefore, if this substrate is used for the photoreceptor to form an image, it becomes the causative factor of scumming.

Here, following the sealing, washing of the anodized film is performed in order to remove the metal salts and the like adhered by the sealing. The washing may be such that the substrate is washed once, however it may be such that the substrate is washed by multisteps of washing. As this time, as the washing solution at the last washing step, there is used clean (deionized) washing solution as much as possible. Moreover, in any one step among the multisteps of washing, a physical rubbing washing using a contact member such as a brush may be performed.

The thickness of the anodized film on the surface of the conductive substrate formed as above is preferable within a range of 3 μm to 15 μm. On the anodized film is present a layer called a barrier layer along the porous shaped most outer surface of a porous anodized film. The thickness of the barrier layer is preferable in a range from 1 nm to 100 nm in the photoreceptor of an exemplary embodiment of the present invention. In the above manner, the anodized conductive substrate 1 can be obtained.

In the conductive substrate 1 obtained in this manner, the anodized film formed on the substrate by anodization has a high carrier blocking property. Therefore, the photoreceptor using this conductive substrate can be installed in the image forming apparatus so as to prevent point defects (black dots and scumming) occurring if print off development (negative/positive development) is performed, and to prevent current leak phenomenon from a contact electrification device which often occurs at the time of contact electrification. Moreover, by sealing the anodized film, the chance of the physical characteristics value over time after forming the anodized film, may be prevented. Moreover, by washing the conductive substrate after sealing, the metal salts and the like adhered on the surface of the conductive substrate by sealing may be removed. If an image is formed by an image forming apparatus comprising a photoreceptor produced using this conductive substrate, it is possible to sufficiently prevent the occurrence of scumming.

Next is a description of details of the under coating layer 4 which may be formed as required. Examples of the material of the under coating layer 4 include: a polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol-formaldehyde resin, and a melamine resin; an organometallic compound containing zirconium, titanium, aluminum, manganese, silicon atoms, and the like.

These compounds may be used solely, or as a mixture or polycondensate of multiple compounds. Among them, an organometallic compound containing zirconium or silicon is preferably used since it has a low residual potential, low potential change due to environment, and low potential change due to repetitive usage. Moreover, the organometallic compound may be used solely, or as a mixture of two or more types, or a mixture with the abovementioned binder resin.

Examples of the organic silicon compound (organometallic compound containing silicon atoms) include vinyltrimethoxysilane, γ-methacryloxypropyl-tris (β-methoxyethoxy)silane, β-(3,4-epoxycyclohexyl) ethyltrimethoxysilane, γ-glycidoxypropyltrimethoxysilane, vinyltriacetoxysilane, γ-mercaptopropyltrimethoxysilane, γ-aminopropyltriethoxysilane, N-β-(aminoethyl)-γ-aminopropyltrimethoxysilane, N-β-(aminoethyl)-γ-aminopropyldimethylmethoxysilane, N, N-bis(β-hydroxyethyl)-γ-aminopropyltriethoxysilane, and γ-chloropropyltrimethoxysilane. Among them, there is preferably used a silane coupling agent such as vinyltriethoxysilane, vinyltris(2-methoxyethoxysilane), 3-methacryloxypropyltrimethoxysilane, 3-glycidoxypropyltrimethoxysilane, 2-(3,4-epoxycyclohexyl)ethyltrimethoxysilane, N-2-(aminoethyl)3-aminopropyltrimethoxysilane, N-2-(aminoethyl) 3-aminopropylmethyldimethoxysilane, 3-aminopropyltriethoxysilane, N-phenyl-3-aminopropyltrimethoxysilane, 3-mercaptopropyltrimethoxysilane, and 3-chloropropyltrimethoxysilane.

Examples of the organic zirconium compound (organometallic compound containing zirconium) include zirconium butoxide, ethyl zirconium acetoacetate, zirconium triethanolamine, acetylacetonato zirconium butoxide, ethyl acetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide and isostearate zirconium butoxide.

Examples of the organic titanium compound (organometallic compound containing titanium) includes tetraisopropyl titanate, tetranormalbutyl titanate, butyl titanate dimer, tetra (2-ethylhexyl) titanate, titanium acetylacetonate, polytitanium acetylacetonate, titanium octylene glycolate, titanium lactate ammonium salt, titanium lactate, titanium lactate ethyl ester, titanium triethanolaminate and polyhydroxytitanium stearate.

The organic aluminum compound (organometallic compound containing aluminum) includes aluminum isopropylate, monobutoxyaluminum diisopropylate, aluminum butyrate, ethylacetoacetate aluminum diisopropylate and aluminum tris(ethylacetoacetate).

Moreover, examples of the solvent used for the under coating layer forming coating liquid which is for forming the under coating layer 4 include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate. These solvents may be used solely or as a mixture of two or more types. As a solvent which can be used when two or more types of solvents are mixed, any solvent may be used as long as a binder resin can be dissolved therein as a mixed solvent.

In the formation of the under coating layer 4, firstly an under coating layer forming coating liquid that has been formulated by dispersing and mixing under coating layer coating agent and a solvent is prepared, and applied on the surface of the conductive substrate. As the application method of the under coating layer forming coating liquid, there may be used a normal method such as a dip coating method, a ring coating method, a wire bar coating method, a spray coating method, a blade coating method, a knife coating method, and a curtain coating method. If the under coating layer is formed, it is preferable to be formed so that the thickness is in a range from 0.1 μm to 3 μm. By setting the thickness of the under coating layer within such a thickness range, potential increase due to desensitization or repetition may be prevented without overstrengthening the electrical barrier.

In this manner, by forming the under coating layer 4 on the conductive substrate, the wettability when coating to form a layer on the under coating layer may be improved, and it can sufficiently serve a function as an electrical blocking layer.

The surface roughness of the under coating layer 4 formed by the above can be adjusted so as to have a roughness within a range between 1 and 1/(4n) times the laser wavelength λ for exposure to be used (where n is the refractive index of a layer provided on the periphery of the under coating layer). The surface roughness is adjusted by adding resin particles in the under coating layer forming coating liquid. By so doing, if the photoreceptor formed by adjusting the surface roughness of the under coating layer is used for the image forming apparatus, interference fringes due to the laser source may be sufficiently prevented. As the resin particles, there may be used silicone resin particles, crosslink-type PMMA resin particles, and the like. Moreover, for adjusting the surface roughness, the surface of the under coating layer may be ground. As the grinding method, there may be used buffing, sandblasting, wet honing, grinding treatment, and the like. In the photoreceptor used for the image forming apparatus of the configuration of positive electrification, laser incident beams are absorbed in the vicinity of the most outer surface of the photoreceptor, and further scattered in the photosensitive layer. Therefore, it is not so strongly needed to adjust the surface roughness of the under coating layer.

It is preferable to add various types of additives to the coating solution for forming the undercoat layer in order to improve electric properties, environmental safety, and the quality of image. Examples of the additives include an electron transport substance that includes a quinone-based compound, such as chloranyl, bromoanil, and anthraquinone, a tetracyanoquinodimethane-based compound, a fluorenone compound, such as 2,4,7-trinitrofluorenone and 2,4,5,7-tetranitro-9-fluorenone, an oxadiazol-based compound, such as 2-(4-biphenyl)-5-(4-t-butylphenyl)-1,3,4-oxadiazole, 2,5-bis(4-naphthyl)-1,3,4-oxadiazole, and 2,5-bis(4-diethyl aminophenyl)1,3,4 oxadiazole, a xanthone-based compound, a thiophene compound, and a diphenoquinone compound, such as 3,3',5,5'-tetra-t-butyldiphenoquinone, an electron transport pigment, such as polycyclic condensates and azos, and a known material, such as a zirconium chelate compound, a titanium chelate compound, an aluminum chelate compound, a titanium alkoxide compound, an organic titanium compound, and a silane coupling agent.

Specific examples of the silane coupling agent used here include silane coupling agents such as vinyltrimethoxysilane, γ-methacryloxypropyl-tris(β-methoxyethoxy)silane, β-(3,4-epoxycyclohexyl)ethyltrimethoxysilane, γ-glycidoxypropyltrimethoxysilanie, vinyltriacetoxysilane, γ-mercaptopropyltrimethoxysilane, γ-aminopropyltriethoxysilane, N-β-(aminoethyl)-γ-aminopropyltrimetlioxysilane, N-P-(aminoethyl)-γ-aminopropylmethyldimethoxysilane, N,N-bis(β-hydroxyethyl)-γ-aminopropyltriethoxysilane, and γ-chloropropyltrimethoxysilane. However, it is not limited to these.

Specific examples of the zirconium chelate compound include zirconium butoxide, zirconium ethyl acetoacetate, zirconium triethanolamine, acetylacetonate zirconium butoxide, ethyl acetoacetatezirconium butoxide, zirconium acetate, zirconium oxalate, zirconium lactate, zirconium phosphnate, zirconium octanoate, zirconium naphthenate, zirconium laurate, zirconium stearate, zirconium isostearate, methacrylate zirconium butoxide, stearate zirconium butoxide, and isostearate zirconium butoxide.

Specific examples of the titanium chelate compound include tetraisopropyl titanate, tetranormalbutyl titanate, butyl titanate dimer, tetra(2-ethylhexyl) titanate, titaniumacetylacetonate, polytitaniumacetylacetonate, titanium octylene glycolate, titanium lactate ammonium salt, titanium lactate, titanium lactate ethyl ester, titanium triethanolaminate and polyhydroxytitanium stearate.

Specific examples of the aluminum chelate compound include aluminum isopropylate, monobutoxyaluminum diisopropylate, aluminum butyrate, ethylacetoacetate aluminum diisopropylate and aluminum tris(ethylacetoacetate).

These additives may be used solely, or as a mixture or polycondensate of multiple compounds.

Moreover, the abovementioned under coating layer forming coating liquid may contain at least one type of electron accepting material. Specific examples of the electron accepting material include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferably used fluorenones, quinines, and benzene derivatives having an electron attractive substituent such as Cl, CN, and NO2. As a result, in the photosensitive layer, the photosensitivity may be improved, the residual potential may be decreased, and the deterioration of photosensitivity when used repeatedly may be reduced. The uneven concentration of the toner image formed by the image forming apparatus including the photoreceptor containing an electron accepting material in the under coating layer may be sufficiently prevented.

Moreover, a dispersion type under coating layer coating agent described below is preferable to be used instead of the abovementioned under coating layer coating agent. As a result, by appropriately adjusting the resistance of the under coating layer, residual charge may be prevented from being accumulated, and the under coating layer may be made thicker. Therefore, the leak resistance of the photoreceptor may be improved, in particular, leaking at the lime of contact electrification may be prevented.

This dispersion type under coating layer coating agent may be, for example, those obtained by dispersing, in a binder resin, metal powder such as aluminum, copper, nickel, and silver; conductive metal oxide such as antimony oxide, indium oxide, tin oxide, and zinc oxide; and conductive material such as carbon fiber, carbon black, and graphite powder. As the conductive metal oxide, metal oxide particles having a mean primary particle size of 0.5 μm or less are preferably used. If the mean primary particle size is too large, conduction paths are often generated locally, readily causing current leaking, which may result in the occurrence of fogging or leaking of large current from the electrification device. The under coating layer 4 is needed to be adjusted to an appropriate resistance in order to improve the leak resistance. Therefore, the abovementioned particles having a mean primary particle size of 0.5 μm or less are preferable to have a powder resistance of 102Ω·cm to 1011Ω·cm or less.

If the resistance of the metal oxide particle is lower than the lower limit of the above range, sufficient leak resistance may not be obtained. If it is higher than the upper limit of this range, the residual potential may be increased. Consequently, among them, metal oxide particles such as stannic oxide, titanium oxide, and zinc oxide are preferably used. Moreover, the metal oxide particles may be used in a mixture of two or more types thereof Furthermore, by performing the surface treatment on the metal oxide particles using a coupling agent, the resistance of the powder may be controlled. As the coupling agent that may be used in this case, similar materials as those for the abovementioned under coating layer forming coating liquid can be used. Moreover, these coupling agents may be used in a mixture of two or more types thereof.

In this surface treatment of the metal oxide particles, any publicly known method can be used, and either a dry method or wet method may be used.

If a dry method is used, firstly the metal oxide particles are heated and dried, to remove the surface adsorbed water. By removing the surface adsorbed water, the coupling agent may be evenly adsorbed on the surface of the metal oxide particles. Next, while stirring the metal oxide particles by a mixer or the like having a large shearing force, the coupling agent, either directly or dissolved in an organic solvent or water, is dropped or sprayed with dry air or nitrogen gas, and thereby the treatment is evenly performed. When the coupling agent is dropped or sprayed, the treatment may be performed at a temperature of 50° C. or more. After adding or spraying the coupling agent, printing may be further performed at a temperature of 100° C. or more. By the effect of the printing, the coupling agent can be cured and a firm chemical reaction with the metal oxide particles can be generated. The printing may be performed at a temperature at which a desired electrophotographic characteristic is obtained, for any range of time.

If a wet method is used, similarly to the dry method, firstly the surface adsorbed water on the metal oxide particles is removed. As the method of removing the surface adsorbed water, in addition to the heat and dry method which is similar to the dry method, there may be performed a method of removing by stirring and heating in a solvent used for surface treatment, and a method of removing by azeotroping with a solvent. Next, the metal oxide particles are stirred in a solvent, and dispersed by using ultrasonic waves, a sandmill, an attritor, a ball mill, or the like. The coupling agent solution is added thereinto, and stirred or dispersed. Then, the solvent is removed, and thereby the treatment is evenly performed. After removing the solvent, printing may be further performed at a temperature of 100° C. or more. The printing may be performed at a temperature at which a desired electrophotographic characteristic is obtained, for any range of time.

The amount of the surface treatment agent with respect to the metal oxide particles may be an amount by which a desired electrophotographic characteristic is obtained. The electrophotographic characteristic is affected by the amount of the surface treatment agent adhered on the metal oxide particles after surface treatment. In the case of the silane coupling agent, the adhered amount is obtained by the Si intensity measured by fluorescent X-ray spectroscopy (caused by silane coupling agent), and the intensity of the main metal element used in the metal oxide. The Si intensity measured by fluorescent X-ray spectroscopy may be within a range of 1.0×10-5 times or more and 1.0×10-3 times or less of the intensity of the main metal element used in the metal oxide. If it is lower than this range, image defects such as blushing may often occur. If it exceeds this range, the concentration may be often decreased due to an increase in the residual potential.

Examples of the binding resin contained in the dispersion type under coating layer coating agent include: a publicly known polymeric resin compound such as an acetal resin (for example, polyvinyl butyral), a polyvinylalcohol resin, casein, a polyamide resin, a cellulose resin, a gelatin, a polyurethane resin, a polyester resin, a methacrylic resin, an acrylic resin, a polyvinylchloride resin, a polyvinyl acetate resin, a vinyl chloride-vinyl acetate-maleic anhydride resin, a silicone resin, a silicone-alkyd resin, a phenol resin, a phenol-formaldehyde resin, a melamine resin, and an urethane resin; a charge transport resin having a charge transport group; and a conductive resin such as polyaniline.

Among them, there is preferably used a resin that is insoluble in a coating solvent of a layer formed on the under coating layer. In particular, a phenol resin, a phenol-formaldehyde resin, a melamine resin, an urethane resin, an epoxy resin, and the like are preferably used. The ratio of the metal oxide particles to the binder resin in the dispersion type under coating layer forming coating liquid may be arbitrarily set within a range by which a desired photoreceptor characteristic may be obtained.

Examples of the method of dispersing the metal oxide particles that have been surface treated by the above method into the binder resin, include a method using a media disperser such as a ball mill, a vibratory ball mill, an attritor, a sandmill, and a horizontal sandmill, or a medialess disperser such as an agitator, an ultrasonic disperser, a roll mill, and a high pressure homogenizer. Furthermore, examples of the high voltage homogenizer include a collision method where a dispersing liquid is dispersed by liquid-liquid collision or liquid-wall collision under a high pressure, and a penetration method where a dispersing liquid is dispersed by making it penetrate through minute channels under a high pressure.

The method of forming the under coating layer by this dispersion type under coating layer coating agent can be performed similarly to the method of forming the under coating layer using the abovementioned under coating layer coating agent.

Next is a description of the photosensitive layer 2, separately for the charge transport layer 2B and the charge generation layer 2A in this order.

Examples of the charge transport material used for the charge transport layer 2B are as follows. That is, there is used a hole transport material such as: oxadiazoles such as 2,5-bis(p-diethylaminophenyl)-1,3,4-oxadiazole; pyrazolines such as 1,3,5-triphenyl-pyrazoline, and 1-[pyridyl-(2)]-3-(p-diethylaminostyryl)-5-(p-diethylaminostyryl)pyrazoline; an aromatic tertiary amino compound such as triphenylamine, tri(p-methyl)phenylamine, N,N-bis(3,4-dimethylphenyl)biphenyl-4-amine, dibenzylaniline, and 9,9-dimethyl-N,N-di(p-tolyl)fluorenone-2-amine; an aromatic tertiary diamino compound such as N,N'-diphenyl-N,N'-bis(3-methylphenyl)-[1,1-biphenyl]-4,4'-diamine; 1,2,4-triazines such as 3-(4'dimethylaminophenyl)-5,6-di-(4'-methoxyphenyl)-1,2,4-triazine; hydrazones such as 4-diethylaminobenzaldehyde-1,1-diphenylhydrazone, 4-diphenylaminobenzaldehyde-1,1-diphenylhydrazone, [p-(diethylamino)phenyl](1-naphthyl)phenylhydrazone, 1-pyrenediphenylhydrazone, 9-ethyl-3-[(2methyl-1-indolinylimino)methyl]carbazole, 4-(2-methyl-1-indolinyliminomethyl)triphenylamine, 9-methyl-3-carbazolediphenylhydrazone, 1,1-di-(4,4'-methoxyphenyl) acrylaldehydediphenylhydrazone, and β, β-bis (methoxyphenyl)vinyldiphenylhydrazone; quinazolines such as 2-phenyl-4-styryl-quinazoline; benzofurans such as 6-hydroxy-2,3-di(p-methoxyphenyl)-benzofuran; α-stilbenes such as p-(2,2-diphenylvinyl)-N,N-diphenylaniline; enamines; carbazoles such as N-ethylcarbazole; poly-N-vinylcarbazole and the derivatives thereof. Examples thereof further include a polymer having a group including any of the above compounds on the main chain or side chain. These charge transport materials may be used solely or in combination of two or more types thereof.

Any binder resin may be used as the binder resin used for the charge transport layer 2B. However, in particular, preferably the binder resin is compatible with the charge transport material and has an appropriate strength.

Examples of this binder resin include: various polycarbonate resins of bisphenol A bisphenol Z, bisphenol C, bisphenol TP, and the like, and the copolymer thereof; a polyalylate resin and the copolymer thereof; a polyester resin; a methacrylic resin; an acrylic resin; a polyvinylchloride resin; a polyvinylidene chloride resin; a polystyrene resin; a polyvinyl acetate resin; a styrene-butadiene copolymer resin; a vinyl chloride-vinyl acetate copolymer resin; a vinyl chloride-vinyl acetate-maleic anhydride copolymer resin; a silicone resin; a silicone-alkyd resin; a phenol-formaldehyde resin; a styrene-acrylic copolymer resin, an styrene-alkyd resin; a poly-N-vinylcarbazole resin; a polyvinyl butyral resin; and a polyphenylene ether resin. These resins may be used solely, or as a mixture of two or more types thereof.

The molecular weight of the binder resin used for the charge transport layer 2B is appropriately selected according to the film-forming condition such as the thickness of the photosensitive layer 2 and the kind of solvent, and usually it is preferably in the range from 3,000 to 300,000 and more preferably from 20,000 to 200,000 in the viscosity-average molecular weight.

The compounding ratio of the charge transport material to the binder resin is preferable in the range from 10:1 to 1:5.

The charge transport layer 2B and/or the charge generation layer 2A described later may contain additives such as an antioxidant, a photostabilizer, and a thermal stabilizer, in order to prevent the deterioration of the photoreceptor due to ozone or oxidizing gas generated in the image forming apparatus, light, or heat.

Examples of the antioxidant include hindered phenol, hindered amine, paraphenylendiamin, arylalkane, hydroquinonie, spirocluomans, spiroindanone, or the derivatives thereof, an organic sulfur compound, and an organophosphorus compound.

Specific examples of the compound of the antioxidant include: a phenolic antioxidant such as 2,6-di-t-butyl-4-methylphenol, styrenated phenol, n-octadecyl-3-(3',5'-di-t-butyl-4'-hydroxyphenyl)-propionate, 2,2'-methylene-bis-(4-methyl-6-t-butylphenol), 2-t-butyl-6-(3'-t-butyl-5-methyl-2'-hydroxybenzyl)-4-methylphenylacrylate, 4,4'-butylidene-bis-(3-methyl-6-t-butyl-phenol), 4,4'-thio-bis-(3-methyl-6-t-butylphenol), 1,3,5-tris(4-t-butyl-3-hydroxy-2,6-dimethylbenzyl)isocyanurate, tetrakis-[methylene-3-(3',5'-di-t-butyl-4'-hydroxy-phenyl)propionate]-methane, and 3,9-bis[2-[3-(3-t-butyl-4-hydroxy-5-methylphenyl) propionyloxy]-1,1-dimethylethyl]-2,4,8,10-tetraoxaspiro[5,5]undecane, 3-3',5'-di-t-butyl-4'-hydroxyphenyl)stearyl propionate.

Examples of the hindered amine compound include bis(2,2,6,6-tetramethyl-4-piperidyl)sebacate, bis(1,2,2,6,6-pentamethyl-4-piperidyl)sebacate, 1-[2-[3-(3,5-di-t-butyl-4-hydroxyphenyl)propionyloxy]ethyl]-4-[3-(3,5-di-t-butyl-4-hydroxyphenyl)propionyloxy]-2,2,6,6-tetramethylpiperidine, 8-benzyl-7,7,9,9-tetramethyl-3-octyl-1,3,8-triazaspiro[4,5]undecane-2,4-dione, 4-benzoyloxy-2,2,6,6-tetramethylpiperidine, succinic acid dimethyl-1-(2-hydroxyethyl)-4-hydroxy-2,2,6,6-tetramethylpiperidine polycondensate, poly[{6-(1,1,3,3-tetramethylbutyl)amino-1,3,5-triazine-2,4-diyl}{(2,2,6,6-tetramethyl-4-piperidyl) imino}hexamethylene{(2,3,6,6-tetramethyl-4-piperidyl) imino}], 2-(3,5-di-t-butyl-4-hydroxybenzyl)-2-n-butyl malonic acid bis(1,2,2,6,6-pentamethyl-4-piperidyl), and N,N'-bis(3-aminopropyl)ethylenediamine-2,4-bis[N-butyl-N-(1,2,2,6,6,-pentamethyl-4piperidyl)amino]-6-chloro-1,3,5-triazine condensate.

Examples of the organic sulfur antioxidant include dilauryl-3,3'-thiodipropionate, dimyristyl-3,3'-thiodipropionate, distearyl-3,3'-thiodipropionate, pentaerythritol-tetrakis-(β-lauryl-thiopropionate), ditridecyl-3,3'-thiodipropionate, and 2-mercaptobenzimidazole.

Examples of the organophosphorus antioxidant include trisnonylphenylphosphate, triphenylphosphate, and tris (2,4-di-t-butylphenyl)-phosphate.

The organic sulfur antioxidants and organophosphorus antioxidants are called a secondary antioxidant, which can increase the antioxidative effect synergistically when used with a primary antioxidant such as a phenol or amine.

Examples of the photostabilizer includes benzophenones, benzotriazoles, dithiocarbamates, and tetramethylpiperidines.

Examples of the benzophenone photostabilizer include 2-hydroxy-4-methoxybenzophenone, 2-hydroxy-4-octoxybenzophenone, and 2,2'-di-hydroxy-4-methoxybenzophenone.

Examples of the benzotriazole photostabilizer includes 2-(-2'-hydroxy-5'methylphenyl-)-benzotriazole, 2-[2'-hydroxy-3'-(3",4",5",6"-tetra-hydrophthalimide-methyl)-5'-methylphenyl]-benzotriazole, 2-(-2'-hydroxy-3'-t-butyl 5'-methylphenyl-)-5-chlorobenzotriazole, 2-(2'-hydroxy-3'-t-butyl-5'-methylphenyl-)-5-chloro benzotriazole, 2-(2'-hydroxy-3',5'-t-butylphenyl-)-benzotriazole, 2-(2'-hydroxy-5'-t-octylphenyl)-benzotriazole, and 2-(2'-hydroxy-3',5'-di-t-amylphenyl-)-benzotriazole.

Examples of other photostabilizers include 2,4, di-t-butylphenyl-3',5'-di-t-butyl-4'-hydroxybenzoate, and nickel dibutyl-dithiocarbamate.

The charge transport layer 2B can be formed by applying and drying a solvent having the charge transport material and the binder resin dissolved in an appropriate solvent. Examples of the solvent used for adjusting the charge transport layer forming coating liquid include: aromatic hydrocarbons, such as benzene, toluene, and chlorobenzene; ketones such as acetone and 2-butanone; halogenated aliphatic hydrocarbons such as methylene chloride, chloroform, and ethylene chloride; cyclic or linear ethers such as tetrahydrofuran, dioxane, ethylene glycol, diethylether; and mixed solvents thereof.

Moreover, the charge transport layer forming coating liquid may be added with a small amount of silicone oil as a leveling agent for improving the smoothness of the coating film formed by coating.

The application of the charge transport layer forming coating liquid can be performed according to the shape and usage of the photoreceptor, by using a method such as a dip coating method, a ring coating method, a spray coating method, a bead coating method, a blade coating method, a roller coating method, a knife coating method, and a curtain coating method. It is preferable to be heated and dried after becoming dry to touch at a room temperature. The heating and drying may be performed in a temperature range of 30° C. to 200° C., for 5 minutes to 2 hours.

The film thickness of the charge transport layer 2B may be preferably in a range of 5 μm to 50 μm, and more preferably in a range of 10 μm to 40 μm.

The charge generation layer 2A may be formed by deposition of a charge generating material by a vacuum deposition method, or coating of a solution containing an organic solvent and a binder resin.

As to the charge generating material, there may be used: amorphous selenium, crystalline selenium, selenium-tellurium alloy, selenium-arsenic alloy, and other selenium compounds; an inorganic photoconductor such as selenium alloy, zinc oxide, and titanium oxide; or a dye-sensitized material thereof; various phthalocyanine compound such as metal-free phthalocyanine, titanyl phthalocyanine, copper phthalocyanine, tin phthalocyanine, and galliumphthalocyanine; various organic pigments such as squaryliums, anthanthrones, perylenes, azos, anthraquinones, pyrenes, pyrylium salt, and thia pyrylium salt; or dyes.

Moreover, these organic pigments generally have several types of crystal forms. In particular, for the phthalocyanine compound, various crystal forms are known such as α type and β type. As long as the pigment provides the sensitivity or other characteristics according to the purpose, any of these crystal forms can be used.

Among the abovementioned charge generating materials, phthalocyanine compounds are preferred. In this case, if light is irradiated on the photosensitive layer, the phthalocyanine compound contained in the photosensitive layer absorbs photons and generates carriers. At this time, since the phthalocyanine compound has a high quantum efficiency, the absorbed photons can be efficiently absorbed to generate carriers.

Furthermore, among the phthalocyanine compound, the phthalocyanine as shown in the following (1) to (3) are more preferred. That is:

(1) Hydroxy gallium phthalocyanine of a crystal form having diffraction peaks at least in the positions of 7.6°, 10.0°, 25.2°, and 28.0° in the Bragg angle (2θ±0.2°) of an X-ray diffraction spectrum using Cu kα rays as a charge generating material.

(2) Chlorogallium phthalocyanine of a crystal form having diffraction peaks at least in the positions of 7.3°, 16.5°, 25.4°, and 28.1° in the Bragg angle (2θ±0.2°) of an X-ray diffraction spectrum using Cu kα ray as a charge generating material.

(3) Titanyl phthalocyanine of a crystal form having diffraction peaks at least in the positions of 9.5°, 24.2°, and 27.3° in the Bragg angle (2θ±0.2°) of an X-ray diffraction spectrum using Cu kα ray as a charge generating material.

These phthalocyanine compounds have not only high photosensitivity in particular, but also high stability of the photosensitivity. Therefore, the photoreceptor having the photosensitive layer containing any one of these phthalocyanine compounds is preferably used as a photoreceptor of a color image forming apparatus which requires high speed image formation and repetitive reproducibility.

Due to the crystal shape and the measurement method, these peak intensity and the position may be slightly out from these values. However, as long as the X-ray diffraction pattern is basically matched, it can be judged to be the same crystal form.

Examples of the binder resin used for the charge generation layer 2A include the following. That is, polycarbonate resins such as bisphenol A type and bisphenol Z type, and the copolymer thereof; a polyalylate resin; a polyester resin; a methacrylic resin; an acrylic resin; a polyvinylchloride resin; a polystyrene resin; a polyvinyl acetate resin; a styrene-butadiene copolymer resin; a vinylidene chloride-acrylnitryl copolymer resin; a vinyl chloride-vinyl acetate-maleic anhydride copolymer resin; a silicone resin; a silicone-alkyd resin; a phenol-formaldehyde resin; styrene-alkyd resin; and a poly-N-vinylcarbazole.

These binder resins may be used solely or in combination of two or more types thereof. The mixing ratio of the charge generation material and the binder resin (charge generation material: binder resin) is desirably within a range between 10:1 and 1:10 by weight ratio. Moreover, generally, the thickness of the charge generation layer 2A is preferably in a range from 0.01 μm to 5 μm, and more preferably in a range from 0.05 μm to 2.0 μm.

Moreover, the charge generation layer 2A may contain at least one type of electron accepting material in order to improve the sensitivity, decrease the residual potential, and decrease the fatigue at the time of repetitive usage. Examples of the electron accepting material used for the charge generation layer include succinic anhydride, maleic anhydride, dibromomaleic anhydride, phthalic anhydride, tetrabromophthalic anhydride, tetracyanoethylene, tetracyanoquinodimethane, o-dinitrobenzene, m-dinitrobenzene, chloranil, dinitroanthraquinone, trinitrofluorenone, picric acid, o-nitrobenzoic acid, p-nitrobenzoic acid, and phthalic acid. Among them, there are particularly preferred fluorenones, quinines, and benzenes having an electron attractive substituent such as Cl, CN, and NO2.

As the method of dispersing the charge generating material into a resin, there may be used a method such as a roll mill, a ball mill, a vibratory ball mill, an attritor, a dinomill, a sandmill, and a colloid mill.

Examples of the solvent of the coating liquid for forming the charge generation layer 2A include a publicly known organic solvent for example: an aromatic hydrocarbon solvent, such as toluene and chlorobenzene; an aliphatic alcohol solvent, such as methanol, ethanol, n-propanol, iso-propanol and n-butanol; a ketone solvent such as acetone, cyclohexanone, and 2-butanone; a halogenated aliphatic hydrocarbon solvent such as methylene chloride, chloroform, and ethylene chloride; a cyclic or linear ether solvent such as tetrahydrofuran, dioxane, ethylene glycol, diethylether; and an ester solvent such as methyl acetate, ethyl acetate, and n-butyl acetate.

These solvents may be used solely or as a mixture of two or more types. If two or more types of solvents are mixed, any solvent may be used as long as a binder resin can be dissolved therein as a mixed solvent. However, if the photosensitive layer has a layer structure where the charge transport layer 2B and the charge generation layer 2A are formed in this order from the conductive substrate side, when the charge generation layer 2A is formed using an application method such as dip coating in which the lower layer is readily dissolved, a solvent which does not dissolve the lower layer such as the charge transport layer is desirably used. Moreover, when the charge Generation layer 2A is formed using a spray coating method or a ring coating method, in which the lower layer is eroded relatively less, the solvent can be widely selected.

As to the intermediate layer, for example when the photoreceptor surface is electrified by an electrification device, in order to prevent a situation where the electrification potential can not be obtained by injecting the electrification charges from the photoreceptor surface to the conductive substrate of the photoreceptor serving as the opposed electrode, a charge injection blocking layer may be formed as required between the surface protective layer 3 and the charge generation layer 2A.

As to the material of the charge injection blocking layer, there may be used the abovementioned silane coupling agent, titanium coupling agent, organic zirconium compound, and organic titanium compound, other organometallic compounds, and a widely-used resin such as polyester, and polyvinyl butyral. The thickness of the charge injection blocking layer is appropriately set by considering the film forming property and the carrier blocking property, in a range from 0.001 μm to 5 μm.

<Process Cartridge and Image Forming Apparatus>

Figure 5:
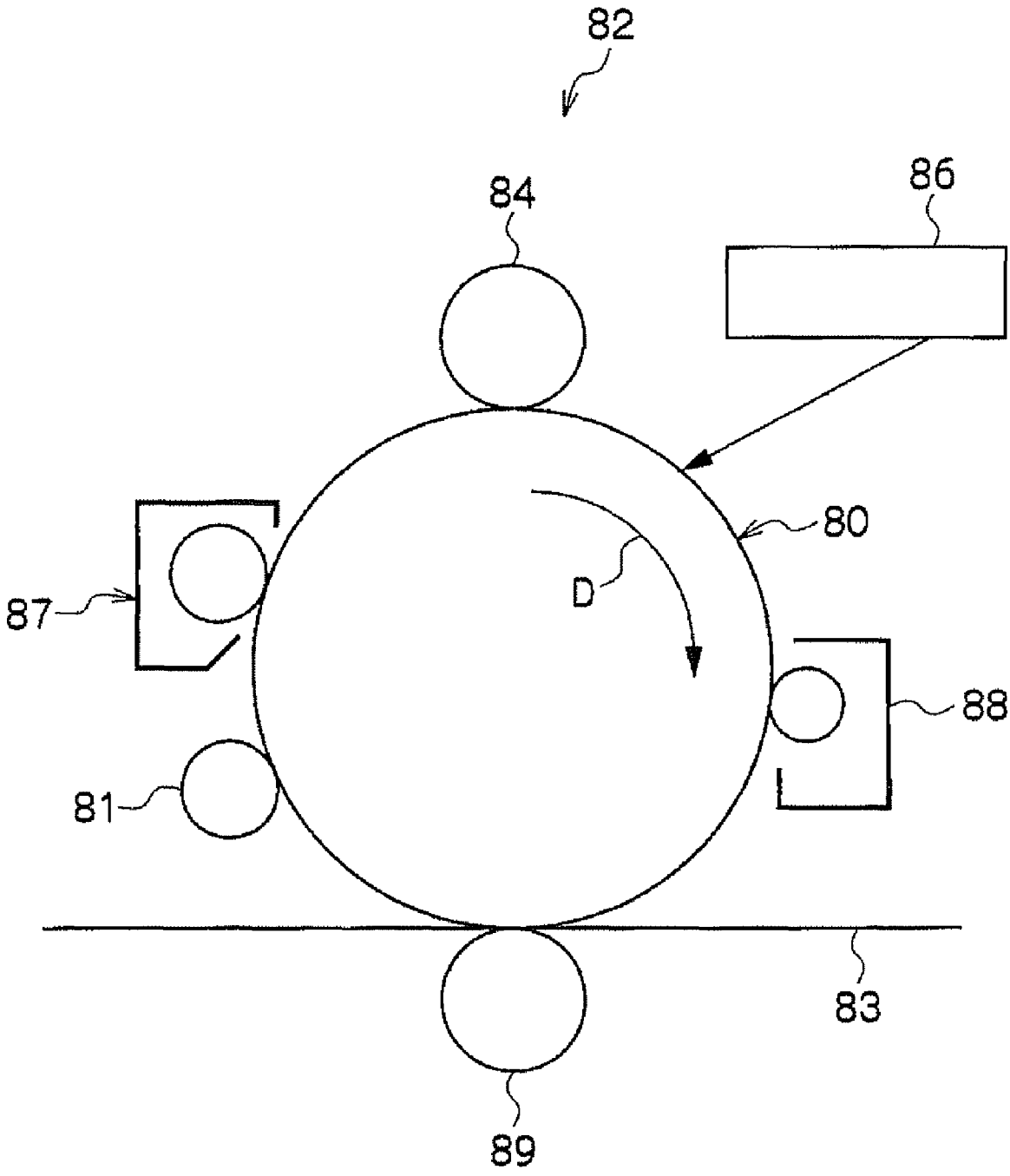
FIG. 5 is a diagram schematically illustrating one example of the process cartridge and image forming apparatus of the invention.

Next, process cartridges and image forming apparatuss including the photoreceptor of the invention are described with reference to exemplary embodiments thereof. As shown in FIG. 5, the image forming apparatus 82 of the exemplary embodiment of the invention is provided with an electrophotographic photoreceptor 80 that rotates in a predetermined direction (the direction D of the arrow in FIG. 5).

A charging unit 84, an exposing unit 86, a developing unit 88, a transferring unit 89, an erasing unit 8 1, and a cleaning member 87 are formed along the rotation direction of the electrophotographic photoreceptor 80 in the vicinity of the electrophotographic photoreceptor 80.

The charging unit 84 electrically charges the surface of the electrophotographic photoreceptor 80 so that the surface has a predetermined potential. The exposing unit 86 exposes the surface of the electrophotographic photoreceptor 80 that is electrically charged by the charging unit 84 to form an electrostatic latent image according to image data. The developing unit 88 stores a developer containing the toner for developing the electrostatic latent image, and supplies the stored developer to the surface of the electrophotographic photoreceptor 80 to develop the electrostatic latent image, thereby forming a toner image.

The transferring unit 89 transfers the toner image formed on the electrophotographic photoreceptor 80 while a recording medium 83 is sandwiched between the electrophotographic photoreceptor 80 and the transferring apparatus, thereby transferring the image onto the recording medium 83. The toner image that is transferred on the recording medium 83 is fixed to the surface of the recording medium 83 using a fixing unit now shown.

The erasing unit 81 removes electricity from the substance that is attached to the surface of the electrophotographic photoreceptor 80 and electrically charged. The cleaning member 87 is provided to come into contact with the surface of the electrophotographic photoreceptor 80, and removes the substance attached to the surface using friction force to the surface of the electrophotographic photoreceptor 80.

Additionally, the image forming apparatus 82 of the exemplary embodiment of the invention may be a tandem apparatus that is provided with a plurality of electrophotographic photoreceptors 80 corresponding to the toners of the various colors. Further, transferring of the toner image onto the recording medium 83 may be performed using an internal transferring process where the toner image formed on the surface of the electrophotographic photoreceptor 80 is transferred onto an internal transfer body and then onto the recording medium.

The process cartridge of the exemplary embodiment of the invention is removably provided with respect to the main body of the image forming apparatus 82, and is united with at least the charging unit 84, and at least one selected from the group consisting of the developing unit 88, the cleaning member 87, and the erasing unit 81.

In the process cartridge of this exemplary embodiment and the image forming apparatus 82 of this exemplary embodiment, it is possible to restrain the occurrence of scratches or wear of the surface of an electrophotographic photoreceptor to obtain images with good quality even in use for a long period of time because of use of an electrophotographic photoreceptor of the invention with a surface having hardness and thickness sufficient for restraining, residual potential increase and for improving the wear resistance in repetitive use in an electrophotographic process.

EXAMPLES

Hereunder is a specific description of exemplary embodiments of the present invention with reference to Examples. However, the present invention is not limited to these Examples.

Example 1

(Preparation of Electrophotographic Photoreceptor)

First, an organic photoreceptor in which an under coating layer, a charge generation layer and a charge transport layer (organic photosensitive layer) has been formed in layer on an Al substrate is prepared in the procedure described below.

-Formation of Under Coating Layer- 100 parts by weight of zinc oxide (average particle diameter: 70 nm, prototype produced by Tayca Corporation) is stirred and mixed with 500 parts by weight of toluene, and then 15 parts by weight of silane coupling agent (commercial name: KBM603, produced by Shin-Etsu Chemical Co., Ltd.), followed by stirring for 2 hours.

Thereafter, toluene is distilled off by vacuum distillation and then printing is performed at 150° C. for 2 hours.

To a solution prepared by dissolving 60 parts by weight of zinc oxide which has been subjected to surface treatment in the way mentioned above, 15 parts by weight of curing agent (blocked isocyanate, commercial name: Sumidur BL3175, produced by Sumika Bayer Urethane Co., Ltd.), and 15 parts by weight of butyral resin (commercial name:SLEC BM-1, produced by Sekisui Chemical Co., Ltd.) in 85 parts by weight of methyl ethyl ketone, 25 parts by weight of methyl ethyl ketone is mixed to yield a liquid to be treated.

Next, using a horizontal media mill disperser (KDL-PILOT type, DYNO-MILL, produced by Shinmaru Enterprises Corporation), dispersion treatment is performed in the following procedures. The cylinder and stirring mill of the disperser are composed of ceramics including zirconia as the principal component. Into the cylinder, glass beads 1 mm in diameter (Hi-Bea D20, produced by Ohara Inc.) are charged in a bulk filling factor 80 volume %, followed by dispersion treatment in a circulation system at a peripheral speed of the stirring mill of 8 m/min and a flow rate of the liquid to be treated of 1000 mL/min. A magnet gear pump is used for sending the liquid to be treated.

In the above-mentioned dispersion treatment, a part of the liquid to be treated is sampled after a specified time elapse, and the transmittance at the time of film formation is measured. That is, the liquid to be treated is applied to a glass plate so that it might have a thickness of 20 μm, and a coating is formed by performing curing treatment at 150° for 2 hours. Thereafter, the transmittance at a wavelength of 950 nm is measured using a spectrophotometer (U-2000, produced by Hitachi. Ltd.). The dispersion treatment is completed when the transmittance (value at a coating thickness of 20 μm) exceeded 70%.

A under coating layer forming coating liquid is prepared by adding 0.005 parts by weight of dioctyltin dilaurate as a catalyst and 0.01 parts by weight of silicone oil (commercial name: SH29PA, produced by Dow Coming Toray Silicone Co., Ltd.) to the dispersion obtained in the way described above. This coating liquid is applied by dip coating to an aluminum substrate having a diameter of 84 mm, a length of 340 mm and a thickness of 1 mm, followed by dry hardening at 160° C. for 100 minutes. Thus, an under coating layer having a thickness of 20 μm is formed.

-Formation of Photosensitive Layer-

Next, a photosensitive layer is formed on the under coating layer. A mixture composed of 15 parts by weight of chlorogallium phthalocyanine of a crystal form having diffraction peaks at least in the positions of 7.4°, 16.6°, 25.5°, and 28.3° in the Bragg angle (2θ±0.2°) of an X-ray diffraction spectrum using Cukα ray as a charge generating material, 10 parts by weight of vinyl chloride-vinyl acetate copolymer resin (commercial name: VMCH, produced by Nippon Unicar Co., Ltd.) as a binder resin, and 300 parts by weight of n-butyl alcohol is subjected to dispersion treatment for 4 hours in a sand mill using glass beads having a diameter of 1 mm. Thus, a charge transport layer forming coating liquid is obtained. The resulting dispersing liquid is applied to the under coating layer by dip coating and then dried. Thus, a charge generation layer having a thickness of 0.2 μm is formed.

Further, a charge transport layer forming coating liquid is prepared by adding 4 parts by weight of N,N-diphenyl-N,N'-bis(3-methylphenyl)-[1,1]biphenyl-4,4'-diamine and 6 parts by weight of bisphenol Z polycarbonate resin (viscosity average molecular weight: 40000) to 80 parts by weight of chlorobenzene and dissolving them. This coating liquid is applied to the charge generation layer and then dried at a temperature of 130° C. for 40 min to form a charge transport layer having a thickness of 25 μm. Thus, an organic photoreceptor (non-coated photoreceptor) is obtained.

-Formation of Protective Layer-

Then, an inorganic thin film layer (protective layer) is formed on the non-coated photoreceptor by p l a s m a CVD. A Si substrate (5 mm×10 mm) for reference sample preparation is stuck to a non-coated photoreceptor with an adhesive tape and then is introduced into a plasma CVD apparatus shown in FIG. 4. The inside of a vacuum chamber 32 is thereafter vacuum exhausted to a pressure of $1\times10^{-2}$ Pa. Then, by supplying 1000 sccm of hydrogen gas, 200 sccm of nitrogen gas and 5 sccm of hydrogen-diluted trimethylgallium gas from a gas feeding pipe 34 into the vacuum chamber 32 via a mass flow controller 36 and by adjusting a conductance valve, the pressure in the vacuum chamber 32 is adjusted to 30 Pa. Thereafter, a 13.56 MHz radiofrequency wave is set to an output of 100 W by use of a high frequency electric source 58 and a matching box 56, followed by discharging from a discharge electrode 54 by matching with a tuner. The reflected wave in this occasion is 0 W. Under such conditions, rotation at a speed of 30 rpm is continued for 100 min, resulting in a photoreceptor having a protective layer. The supply of the hydrogen-diluted trimethylgallium gas is performed by bubbling hydrogen as a carrier gas into trimethylgallium kept at 0° C. The color of the thermostat tape stuck showed that the temperature during the film formation is about 60° C. The thermostat tape used here is a sticker for measuring temperature (commercial name: Temp Plate P/N101, produced by Wahl Co., Ltd).

Subsequently, the resulting photoreceptor is left at rest in an environment conditioned at a temperature of 20° C. for 24 hours.

Then, in observation of the surface of the photoreceptor with a light microscope (magnification: ×50), a plurality of linear cracks are recognized and a portion closed with such cracks is also found. The crack interval greatest in the field of view is 9.2 mm.

Further, for the cracks, the maximum width of each crack is measured using a scanning electron microscope (SEM) (magnification: ×5000). As a result of examination of 50 cracks, the maximum width is 0.54 μm in average. Examination of the depth of the cracks by means of an atomic force microscope (AFM) showed that almost all cracks has reached the photosensitive layer, which is the lower layer of the protective layer.

The measurement, using a surface texture and contour measuring instrument SURFCOM 550A produced by Tokyo Seimitsu Co., Ltd., of the level difference between a film-noncoated portion and a film-coated portion produced by removal of the Si substrate revealed that the thickness of the protective layer is 0.24 μm.

The infrared absorption spectrum of the sample in which the film has been formed on the Si substrate showed that the film is GaN containing hydrogen.

(Evaluation)

Next, the electrophotographic photoreceptor in which the protective layer has been formed is installed as a photoreceptor into a process cartridge for DOCUCENTER COLAR 500 produced by Fuji Xerox Co., Ltd. The process cartridge is attached to a DocuCenter Colar 500 and a print test of forming images (300 dpi, 30% area coverage) on an A4-sized paper (commercial name, P PAPER, produced by Fuji Xerox Office Supply Co., Ltd.) is conducted.

-Concentration Unevenness-

Under the conditions mentioned above 100 sheets are outputted, and the output image samples of the 10th and 100th sheets are evaluated by visual inspection. On the basis of the result, the concentration unevenness of halftone images is estimated according to the following criteria.

A: No concentration unevenness is recognized in the image samples on the 10th and 100th sheets.

B: Some concentration unevenness is recognized, which however is so slight that no problems will arise.

C: Concentration unevenness is recognized, which is so considerable that it will cause problems.

-Image Concentration-

Following 100-sheet output, a solid image with an area coverage of 100% is printed continuously on 10 sheets. For the resulting images, when decrease in image concentration is clearly recognized at a glance, the image concentration is judged to decrease.

-Potential Property-

Next, the potential property of the electrophotographic photoreceptor provided with protective layer is evaluated.

First, for the non-coated photoreceptor before the above-mentioned protective layer formation and the photoreceptor provided the protective layer, light for exposure (light source: semiconductor laser, wavelength: 780 nm, output: 5 mW) is scanned on the surface of a photoreceptor in rotation at 40 rpm under charging at −700 V using a scorotron charger. Thereafter, the residual potential of the entire surface of the photoreceptor is measured.

In the measurement, a surface potential meter (MODEL 344, produced by Trek Japan KK) is used. A probe having a measuring band width of 10 mm (MODEL 555P-1, produced by Trek Japan KK) is used as a probe. The probe is located 2 mm away from a photoreceptor and a map is produced by measuring the potential while scanning in the drum axial direction and in the rotation direction. Thus, the potential condition (residual potential) in the entire surface of the photoreceptor is examined. As a result, it is found that the potential of the entire surface of the non-coated photoreceptor is uniformly −20 V, whereas that of the photoreceptor having a protective layer is uniformly −40 V or less, which is in good level.

In this evaluation, the greater the residual potential width, the larger the site-by-site variation in potential. The results of the above-described evaluations are summarized in Table 1.

Example 2

(Preparation of Electrophotographic Photoreceptor)

To a photoreceptor (the maximum crack interval has been confirmed to be 9.3 mm) which is obtained in the same manner as the preparation of the electrophotographic photoreceptor in Example 1 and which has a protective layer (referred to as first protective layer), a Si substrate (5 mm×10 mm) for reference sample preparation is stuck with an adhesive tape and then is introduced into a plasma CVD apparatus shown in FIG. 4. The inside of the a vacuum chamber 32 is thereafter vacuum exhausted to a pressure of $1\times10^{-2}$ Pa. Then, by supplying 1000 sccm of hydrogen gas, 20 sccm of helium-diluted oxygen gas (5% oxygen) and 5 seem of hydrogen-diluted trimethylgallium gas from a gas feeding pipe 34 into the vacuum chamber 32 via a mass flow controller 36 and by adjusting a conductance valve, the pressure in the vacuum chamber 32 is adjusted to 30 Pa. Thereafter, a 13.56 MHz radiofrequency wave is set to an output of 100 W by use of a high frequency electric source 58 and a matching box 56, followed by discharging from a discharge electrode 54 by matching with a tuner. The reflected wave in this occasion is 0 W. Under such conditions, rotation at a speed of 30 rpm is continued for 60 min, resulting in a photoreceptor having a second protective layer.

Elemental analysis of the reference sample in which the second protective layer has been formed showed that a gallium oxide film containing hydrogen in an amount Ga:O:H=2:3:1 is formed. The level difference measurement revealed that the thickness of the second protective layer is 0.20 μm.

Using this photoreceptor, evaluation of a photoreceptor is conducted in the same manners as Example 1. The results are shown in Table 1.

Example 3

Crack formation in a protective layer is conducted in the same manner as Example 1 except that, in the preparation of the electrophotographic photoreceptor of Example 1, the photoreceptor after the protective layer formation is introduced into a thermostat to adjust the temperature of the environment where the sample is left at rest to 0° C. As a result, cracks denser than Example 1 are formed in the surface of the photoreceptor. Light microscopic observation showed that the maximum crack interval is 2.5 mm. The maximum width of the cracks is 0.43 μm in average.

Using the photoreceptor, evaluation of a photoreceptor is conducted in the same manners as Example 1. The results are summarized in Table 1.

Example 4

A photoreceptor having a protective layer is prepared in the same manner as Example 1 except that, in the preparation of the electrophotographic photoreceptor of Example 1, the discharge time for the protective layer formation is changed to 150 min. Subsequently, this photoreceptor is left at rest in an environment conditioned at a temperature of 20° C. for 24 hours.

The level difference measurement revealed that the thickness of the protective layer is 0.36 μm.

Observation of the surface of the photoreceptor after being left at rest showed that cracks denser than Example 1 are formed in the surface of the photoreceptor. Light microscope observation revealed that the maximum crack interval is 7.2 mm. The maximum width of the cracks is 0.48 μm in average.

Using the photoreceptor, evaluation of a photoreceptor is conducted in the same manners as Example 1. The results are summarized in Table 1.

Comparative Example 1

A photoreceptor having a protective layer is prepared in the same manner as Example 1 except that, in the preparation of the electrophotographic photoreceptor of Example 1, the discharge time for the protective layer formation is changed to 90 min. Subsequently, this photoreceptor is left at rest in an environment conditioned at a temperature of 20° C. for 24 hours.

The level difference measurement revealed that the thickness of the protective layer is 0.20 μm.

Observation of the surface of the photoreceptor after being left at rest showed that cracks coarser than Example 1 are formed in the surface of the photoreceptor. Light microscope observation revealed that the maximum crack interval is 15.2 mm. The maximum width of the cracks is 0.50 μm in average.

The photoreceptor is evaluated in the same manner as Example 1. The results are summarized in Table 1. With regard to concentration unevenness, many island-like portions with reduced output image concentration are found. Observation of the surface of the photoreceptor at positions corresponding to the island-shaped portions showed that these portions corresponded to portions where the crack interval is over 10 mm.

Comparative Example 2

On a photoreceptor (the maximum crack interval has been confirmed to be 15.4 mm) which is obtained in the same manner as the preparation of the electrophotographic photoreceptor in Comparative Example 1 and which has a protective layer (referred to as first protective layer), a second protective layer is formed under the same conditions as those shown in Example 2. Using this photoreceptor, evaluation of a photoreceptor is conducted in the same manners as Example 1. The results are shown in Table 1. With regard to concentration unevenness, like in Comparative Example 1, many island-like portions with reduced output image concentration are found. Observation of the surface of the photoreceptor at positions corresponding to the island-shaped portions showed that these portions corresponded to portions where the crack interval is over 10 mm.

TABLE 1

| | First protective layer | | | Evaluation | | |
|---|---|---|---|---|---|---|
| | Thickness (μm) | Crack interval (mm) | Second protective layer Thickness (μm) | Concentration unevenness | Image concentration decrease | Residual potential (V) |
| Example 1 | 0.24 | 9.2 | — | A | No | −40 |
| Example 2 | 0.24 | 9.3 | 0.20 | A | No | −80 to −90 |
| Example 3 | 0.24 | 2.5 | — | A | No | −40 |
| Example 4 | 0.36 | 7.2 | — | A | No | −48 |
| Comparative example 1 | 0.20 | 15.2 | — | C | Yes | −50 to −100 |
| Comparative example 2 | 0.20 | 15.4 | 0.20 | C | Yes | −100 to −180 |

As shown in Table 1, although a GaN layer, which is a protective layer, has a larger thickness, the residual potential is lower in Example 1 and Example 2 in comparison to Comparative Example 1 and Comparative Example 2, respectively. Even when a thick inorganic thin film protective layer has been formed, it is possible to reduce the residual potential of a photoreceptor remarkably by causing the layer to have cracks with intervals of 10 mm or about 10 mm or less.

According to an exemplary embodiment of the present invention, it is possible to provide an electrophotographic photoreceptor which may control occurrence of in-plane image concentration unevenness due to a superfluous residual potential and defects such as cracks and which may exert high durability and good electric property simultaneously.

According to another exemplary embodiment of the present invention, it is possible to make a protective layer being a harder film and to easily form cracks at desired intervals.

According to another exemplary embodiment of the present invention, it is possible to make the surface of the protective layer being a surface excellent in smoothness and water repellency and to obtain highly durable electrophotographic photoreceptors.

According to another exemplary embodiment of the present invention, it is possible to effectively obtain electrophotographic photoreceptors having an uppermost surface having more improved water repellency.

According to another exemplary embodiment of the present invention, it is possible to restrain the occurrence of in-plane image concentration unevenness accompanying defects such as cracks to make it easy to deal with electrophotographic photoreceptors possessing both high durability and satisfactory electric properties, thereby improving the applicability to image forming apparatuses having various configurations.

According to another exemplary embodiment of the present invention, it is possible to obtain high-quality images without in-plane image concentration unevenness or decrease in image concentration stably for a long, period of time.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising an organic photosensitive layer and one or more inorganic thin film layers disposed in this order on a conductive substrate, among the one or more inorganic thin film layers at least an inorganic thin film layer disposed directly on the organic photosensitive layer having cracks scattered at intervals from about 1 μm to about 10 mm, wherein the inorganic thin film layer having the cracks is a first protective layer and an inorganic thin film is grown on a surface of the first protective layer to form a second protective layer.

2. The electrophotographic photoreceptor according to claim 1, wherein the inorganic thin film layer comprises a group 13 element and nitrogen.

3. The electrophotographic photoreceptor according to claim 1, wherein an uppermost inorganic thin film layer comprises a group 13 element and oxygen.

4. A process cartridge configured to be attached to and detached from an image forming apparatus, the process cartridge comprising an electrophotographic photoreceptor, and at least one selected from the group consisting of a charging unit for charging a surface of the electrophotographic photoreceptor, a developing unit for forming a toner image by developing an electrostatic latent image formed on the surface of the electrophotographic photoreceptor with a developer including at least a toner and a transfer unit for transferring the toner image to a recording medium, the electrophotographic photoreceptor being the electrophotographic photoreceptor according to claim 1.

5. The process cartridge according to claim 4, wherein the inorganic thin film layer of the electrophotographic photoreceptor comprises a group 13 element and nitrogen.

6. The process cartridge according to claim 4, wherein an uppermost inorganic thin film layer of the electrophotographic photoreceptor comprises a group 13 element and oxygen.

7. An image forming apparatus comprising an electrophotographic photoreceptor, a charging unit for charging a surface of the electrophotographic photoreceptor, an exposure unit for exposing the surface of the electrophotographic photoreceptor charged by the charging unit to form an electrostatic latent image, a developing unit for developing the electrostatic latent image with a developer including at least a toner to form a toner image, and a transfer unit for transferring the toner image to a recording medium, wherein the electrophotographic photoreceptor is the electrophotographic photoreceptor according to claim 1.

8. The image forming apparatus according to claim 7, wherein the inorganic thin film layer of the electrophotographic photoreceptor comprises a group 13 element and nitrogen.

9. The image forming apparatus according to claim 7, wherein an uppermost inorganic thin film layer of the electrophotographic photoreceptor comprises a group 13 element and oxygen.

* * * * *